US011649087B2

(12) United States Patent
Appendini et al.

(10) Patent No.: US 11,649,087 B2
(45) Date of Patent: May 16, 2023

(54) MULTI-COMPARTMENT RIGID TRAY WITH RECLOSEABLE RIGID DOME LID

(71) Applicant: The Quaker Oats Company, Chicago, IL (US)

(72) Inventors: Paola Appendini, Northbrook, IL (US); David Block, Brooklyn, NY (US); Paulette Bluhm-Sauriol, Grandview, NY (US); Ryan Boudreaux, Yorktown Heights, NY (US); Peter Brian Clarke, Newtown, CT (US); Rebecca Eley, Brooklyn, NY (US); Geoffrey Gibbins, Brooklyn, NY (US); Eric Thomas Henderson, Chicago, IL (US); James J. Maki, McHenry, IL (US); Jorge W. Maldonado, Frisco, TX (US); Donald E. McCumber, Madison, WI (US); Megan Sklanka, New York City, NY (US); James Troy Starkey, North Haven, CT (US)

(73) Assignee: The Quaker Oats Company, Chicago, IL (US)

( * ) Notice: Subject to any disclaimer, the term of this patent is extended or adjusted under 35 U.S.C. 154(b) by 343 days.

(21) Appl. No.: 15/802,530

(22) Filed: Nov. 3, 2017

(65) Prior Publication Data

US 2019/0135478 A1 May 9, 2019

(51) Int. Cl.
*B65D 1/36* (2006.01)
*B65D 43/02* (2006.01)
(Continued)

(52) U.S. Cl.
CPC ..... *B65D 1/36* (2013.01); *A45C 11/20* (2013.01); *B65D 43/0204* (2013.01);
(Continued)

(58) Field of Classification Search
CPC ..... B65D 1/36; B65D 43/06; B65D 43/0204; B65D 2543/0062; B65D 2543/00833;
(Continued)

(56) References Cited

U.S. PATENT DOCUMENTS 3,107,027 A * 10/1963 Hong ..... B65D 1/36 220/575
3,708,086 A * 1/1973 Colato ..... B65D 1/36 220/361

(Continued)

*Primary Examiner* — Anthony D Stashick
*Assistant Examiner* — Prince Pal
(74) *Attorney, Agent, or Firm* — Barnes & Thornburg LLP; G. Peter Nichols

(57) ABSTRACT

Disclosed are rigid multi-compartment recloseable packages. A package may comprise a rigid tray comprising a product surface to hold food products. The tray may comprise a raised lip along a perimeter of the product surface to laterally secure the food products thereon. The tray may have a tray skirt horizontally extending outward from a top edge of the lip, and dividing features upwardly extending from the product surface to form distinct compartments on the product surface for receiving the food products therein. Furthermore, such an exemplary package also comprises a recloseable rigid lid having an upper surface substantially coextensive with the product surface, and at least one sidewall downwardly extending from the upper surface. The lid may also comprise a lid skirt horizontally extending outward from a bottom edge of the at least one sidewall, where the lid skirt is coextensive and complimentary in shape with the tray skirt.

14 Claims, 13 Drawing Sheets

(51) Int. Cl.
*B65D 43/06* (2006.01)
*A45C 11/20* (2006.01)

(52) U.S. Cl.
CPC ..... *B65D 43/0212* (2013.01); *B65D 43/06* (2013.01); *B65D 2543/0062* (2013.01); *B65D 2543/00064* (2013.01); *B65D 2543/00101* (2013.01); *B65D 2543/00296* (2013.01); *B65D 2543/00537* (2013.01); *B65D 2543/00574* (2013.01); *B65D 2543/00657* (2013.01); *B65D 2543/00685* (2013.01); *B65D 2543/00694* (2013.01); *B65D 2543/00731* (2013.01); *B65D 2543/00768* (2013.01); *B65D 2543/00796* (2013.01); *B65D 2543/00805* (2013.01); *B65D 2543/00833* (2013.01); *B65D 2543/00842* (2013.01); *B65D 2543/00953* (2013.01)

(58) Field of Classification Search
CPC ..... B65D 2543/00731; B65D 2543/00768; B65D 2543/00657; B65D 2543/00064; B65D 2543/00953; A45C 11/20
USPC ..... 220/555, 780, 793
See application file for complete search history.

(56) References Cited

U.S. PATENT DOCUMENTS 3,795,360 A * 3/1974 Bianchi ..... B65D 43/0212 D7/392.1
3,850,333 A * 11/1974 Reichert ..... B65D 1/36 D7/541
4,279,354 A * 7/1981 Conti ..... B65D 1/36 220/555
4,328,254 A * 5/1982 Waldburger ..... B65D 81/343 426/106
4,555,043 A * 11/1985 Bernhardt ..... B65D 43/0218 220/257.1
5,236,119 A * 8/1993 Chu ..... B65D 1/36 220/555
5,277,920 A 1/1994 Weaver, Jr.
5,624,051 A * 4/1997 Ahern, Jr. ..... B65D 21/0233 220/793
5,657,874 A * 8/1997 Hustad ..... B65D 1/36 206/45.24
5,762,231 A * 6/1998 Rider, Jr. ..... B65D 43/021 206/541
5,853,105 A 12/1998 Roman et al.
6,056,138 A * 5/2000 Chen ..... B65D 43/0212 206/505
6,467,647 B1 * 10/2002 Tucker ..... B65D 21/0233 206/508
7,083,818 B2 * 8/2006 Pratte ..... B65D 77/046 426/115
7,172,779 B2 * 2/2007 Castellanos ..... B65D 1/34 426/106
7,735,651 B2 * 6/2010 Shew ..... B65D 51/249 206/541
8,006,369 B2 * 8/2011 Shew ..... B65D 51/249 264/553
D649,033 S * 11/2011 Epstein ..... D9/425
8,056,751 B2 * 11/2011 Vovan ..... B65D 43/0212 220/300
8,307,982 B1 * 11/2012 Vovan ..... B65D 1/22 206/467
D737,102 S * 8/2015 Hand ..... D7/542
D748,469 S * 2/2016 Snedden ..... D9/425
9,469,458 B2 * 10/2016 Padda ..... B65D 43/16
D798,165 S * 9/2017 Snedden ..... D9/418
10,329,064 B2 * 6/2019 Biery ..... B65D 75/366
10,343,809 B2 * 7/2019 Knutson ..... B65D 51/18
10,442,581 B2 * 10/2019 Gartz ..... B65D 43/267
D905,573 S * 12/2020 Flanagan ..... D9/425
11,180,289 B2 * 11/2021 Kobayashi ..... B65D 43/0218
2004/0026430 A1 * 2/2004 Baker ..... B65D 43/162 220/4.23
2004/0031799 A1 * 2/2004 Dege ..... B65D 1/36 220/523
2007/0196541 A1 * 8/2007 Vovan ..... B65D 21/0222 426/106
2009/0045190 A1 * 2/2009 Gutierrez ..... H05B 6/6494 219/730
2009/0084805 A1 * 4/2009 Bryson ..... B65D 43/0208 220/790
2009/0089993 A1 * 4/2009 Shew ..... B65D 1/36 29/428
2009/0092719 A1 * 4/2009 Shew ..... B65D 43/0212 206/561
2009/0155435 A1 * 6/2009 Loaiza ..... B65D 1/36 426/396
2009/0186132 A1 * 7/2009 Mangino ..... B65D 1/36 206/541
2009/0206090 A1 * 8/2009 Hanson ..... B65D 43/0212 220/526
2010/0122930 A1 * 5/2010 Manca ..... B65D 51/1611 206/551
2010/0320212 A1 * 12/2010 Cai ..... B65D 1/26 220/526
2014/0224804 A1 * 8/2014 Pickering ..... B65D 43/26 156/292
2014/0284346 A1 * 9/2014 McCumber ..... B65D 43/162 220/792
2015/0307257 A1 * 10/2015 Padda ..... B65D 1/36 206/508
2016/0260352 A1 * 9/2016 Ortiz ..... G09B 19/00
2017/0158396 A1 * 6/2017 Guirguis ..... B65D 50/00
2018/0016066 A1 * 1/2018 Strachan ..... B65D 1/34
2019/0002159 A1 * 1/2019 Siskindovich ..... B65D 43/0222
2019/0352039 A1 * 11/2019 Lane ..... B65D 1/44
2020/0399018 A1 * 12/2020 Mueller ..... B65D 43/162
2022/0017270 A1 * 1/2022 McCumber ..... B65D 43/0249
2022/0161972 A1 * 5/2022 Dominion ..... B65D 51/20

* cited by examiner

MULTI-COMPARTMENT RIGID TRAY WITH RECLOSEABLE RIGID DOME LID

TECHNICAL FIELD

The present disclosure relates to snack packages, and in particular to a multi-compartment rigid tray with a recloseable rigid dome lid.

BACKGROUND

Various container and package designs have been used in the past to contain and display snack food products. Among the many existing snack containers and packages, some have contained multiple compartments for separately holding different types of snack products in a single package. For example, U.S. Pat. No. 5,657,874, Hustad et al., describes a rigid plastic base tray having at least three compartments covered with a flexible film that hermetically seals each of the compartments. U.S. Pat. No. 5,853,105, Roman et al., discloses a circular container comprised of two compartments hermetically sealed by a film placed over the top of the two compartments. U.S. Pat. No. 5,277,920, Weaver, Jr., discloses a food package consistent of two separate compartments covered by sealing means. However, each of these conventional snack packages provide multiple compartments for holding various snack products that are downwardly formed from an upper flat surface of the rigid container. Flexible film is used them laid across this upper flat surface to provide a seal for the snacks held in the downwardly formed compartments.

Unfortunately, this conventional design of multi-compartment snack packages suffers from several disadvantages. For example, the downwardly formed compartments only permit access to the various snack products held therein from the top of each compartment. This can often make it difficult for a consumer to reach down into a compartment to grasp the product, especially if the compartment(s) are relatively deep and the quantity of remaining snack product in such compartment(s) is low. Additionally, the products held in the various downwardly formed compartments are not readily visible to consumers. Thus, if such conventional multi-compartment packages are stacked on a display shelf, consumer may have to pick up a package and turn it in various directions to ascertain exactly what is held in each downwardly formed compartment. Furthermore, such conventional packages with downwardly formed compartments typically form the compartments of flexible or semi-flexible material, which permits easier crushing of the products within the compartments should external forces, including the mere grasping of the container by a consumer, be applied to the sides of one or more of the compartments.

Still further, the peelable films laid over the top surfaces of such conventional multi-compartment packages is not typically resealable over the package once it is open. Even in packages where the film can be laid back over the top surface of the package, the consumer's view of what product(s) remain in the various downwardly formed compartments is again obscured. Moreover, the mere use of flexible films over the top surfaces of such conventional multi-compartment snack packages is a weak material, which can be easily punctured during shipping of such packages or even the stacking of multiple similar packages on a display shelf.

Therefore, there is a need for an improved multi-compartment package for holding food products that does not suffer from these and other deficiencies found in conventional packages. The disclosed principles provide such improved package.

SUMMARY

To overcome the deficiencies of the prior art, the disclosed principles provide for new and unique recloseable package, having a rigid multi-compartment tray and a rigid recloseable lid. In one exemplary embodiment, a recloseable package in accordance with the disclosed principles comprises a rigid tray comprising a product surface configured to hold one or more food products thereon. Such a tray may also comprise a raised lip along a perimeter of the product surface and configured to laterally secure the one or more food products on the product surface. The tray may also have a tray skirt horizontally extending outward from a top edge of the raised lip, and one or more dividing features upwardly extending from the product surface and configured to form distinct compartments on the product surface of the tray for receiving the one or more food products therein. Furthermore, such an exemplary package also comprises a recloseable rigid lid having an upper surface substantially coextensive with the product surface, and at least one sidewall downwardly extending from the upper surface. The rigid lid may also comprise a lid skirt horizontally extending outward from a bottom edge of the at least one sidewall, where the lid skirt is coextensive and complimentary in shape with the tray skirt so as to hold the lid on the tray.

In some embodiments, a recloseable package according to disclosed principles may have the tray skirt and the lid skirt each further comprise corresponding vertically extending components. The corresponding vertically extending components of the tray skirt and the lid skirt may each further comprise a complimentary shaped securing feature configured to mate with one another to secure the lid on the tray. Also, the complimentary shaped securing features may comprise a plurality of inwardly curved portions horizontally distributed on each corresponding vertically extending component. Alternatively, the complimentary shaped securing features may comprise an outwardly curved portion horizontally coextensive with each corresponding vertically extending component.

In some embodiments, the recloseable package may further comprise respective corresponding sealing flanges horizontally extending outward from the corresponding vertically extending components of the tray and lid, where the corresponding sealing flanges are configured to be sealed to one another to hermetically seal the lid on the tray.

In some embodiments of a recloseable package according to the disclosed principles, the vertically extending components each extend downwardly. In other embodiments, the vertically extending components each extend upwardly.

In some embodiments, a recloseable package in accordance with the disclosed principles further comprises a pull tab horizontally extending outward from respective vertically extending components. In such embodiments, the pull tabs are configured to be grasped by a consumer to remove the lid from the tray. In more specific embodiments, the pull tabs may each comprise textured features to assist the consumer with grasping the pull tabs.

In some embodiments, the rigid lid of a recloseable package is semi-transparent. In other embodiments, the rigid lid is transparent. In both such embodiments, the rigid tray may be opaque.

In some embodiments of a recloseable package according to the disclosed principles the one or more dividing features of the tray are integrally formed as a unitary piece with the product surface of the tray. Also, in some embodiments, the distinct compartments formed by the one or more dividing features each comprise substantially the same shape and size. In alternative embodiments, the compartments are of varying sizes and shapes.

Also, in exemplary embodiments, the one or more dividing features may comprise a downward slope when moving from a center of the tray to the raised lip. Such embodiments allow view of the product from the side of the package when the rigid lid is at least semi-transparent, as well as easier grasping of such product by consumers. In other embodiments, the dividing features may be inversely sloped in the opposite direction or are not sloped at all.

Numerous embodiments and advantages associated with each such embodiment are discussed in further detail below.

BRIEF DESCRIPTION OF THE DRAWINGS

The detailed description that follows, by way of non-limiting examples of embodiments, makes reference to the noted drawings in which reference numerals represent the same parts throughout the several views of the drawings, and in which.

DETAILED DESCRIPTION

In view of the foregoing, through one or more various aspects, embodiments and/or specific features, the present disclosure is intended to bring out one or more of the advantages that will be evident from the description. The present disclosure makes reference to one or more specific embodiments by way of illustration and example. It is understood, therefore, that the terminology, examples, drawings and embodiments are illustrative and are not intended to limit the scope of the disclosure.

Figure 1:
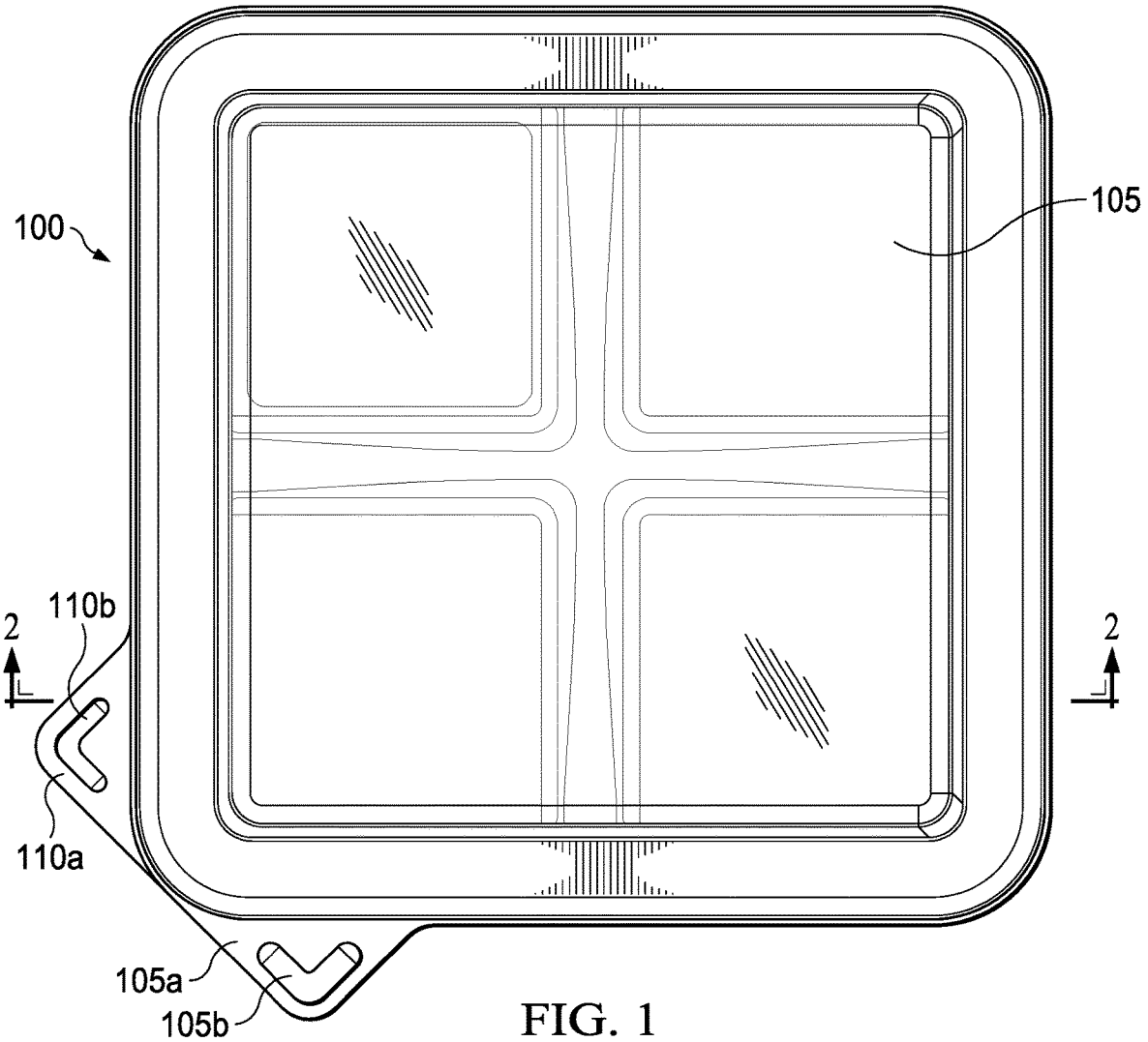
FIG. 1 illustrates a top view of a first embodiment of a rigid multi-compartment recloseable package constructed in accordance with the disclosed principles.

FIG. 1 illustrates a top view of one embodiment of a rigid multi-compartment recloseable package 100 constructed in accordance with the disclosed principles. From this top view, this embodiment of the package 100 is formed having four sides, and in the shape of a square. Also, the four corners of the package 100 are rounded off. The package 100 is comprised of a rigid lid 105 fitted completely over a rigid tray 110. The rigid lid 105 of the package 100 is semi-transparent in this embodiment, which allows visibility of a piece of product 115 being held within the package 100. As used herein, the terms "rigid" and "rigid material" are used to mean a material having sufficient resiliency to maintain its form or shape even though the material has some amount of flexibility to be temporarily distorted.

Also visible from this top view are a lid tab 105*a* and tray tab 110*a*, which in this embodiment may be grasped by a consumer and pulled in opposite directions, with the lid tab 105*a* being pulled upwardly and the tray tab 110*a* being pulled downwardly and away from the lid tab 105*a*, to separate the lid 105 from the tray 110. Texture features 105*b* and 110*b* may also be provided on the respective tabs 105*a*, 110*a*, to assist the consumer in maintaining their grasp of the tabs 105*a*, 110*a* when used to open the package 100 in this manner.

Figure 2:
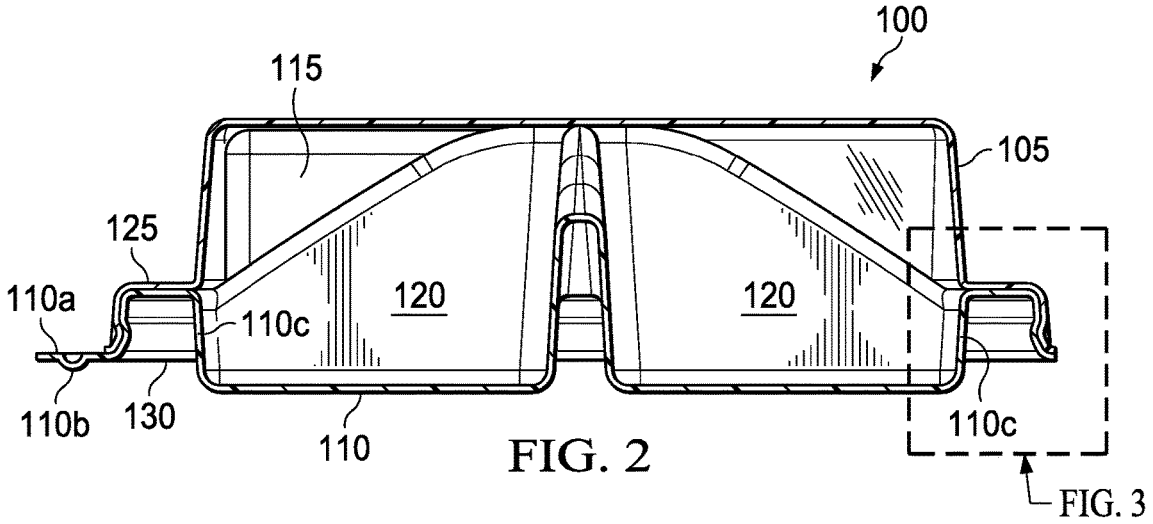
FIG. 2 illustrates a side cross-sectional view of the package of FIG. 1 taken along line 2-2.

Turning to FIG. 2, illustrated is a side cross-sectional view of the package 100 of FIG. 1 taken along line 2-2. From this cross-sectional view, both the lid 105 and the tray 110 can be seen. Also visible from this cross-sectional view are the uniquely shaped formed raised walls 120 that rise up from the bottom surface of the rigid tray 110 and create the multiple compartments on the tray 110.

In particular, the dividing walls 120 in this illustrated embodiment are tapered or sloped from the center of the tray 110 towards the outer periphery of the tray 110. This tapered structure for the walls 120 may also be sloped so that the bottom periphery of the tray 110 includes a raised lip 110*c* that helps secure the product 115 held on the tray 110 from sliding off of the tray 110 when the lid 105 is not mounted on the tray 110. This tapered/sloped structure for the walls 120 also permits partial viewing of the product 115 within the package 100 from the side by a consumer in those embodiments having a transparent or semi-transparent lid 105. Still further, as mentioned above this tapered structure for the walls 120 allows easier grasping of the product 115 on the tray 110 by a consumer's fingertips, once he or she has removed the lid 105 from the tray 110.

Formation of the raised walls 120 on the tray 110 can be done in various manners. In this illustrated embodiment, the walls 120 are integrally formed as raised portions of the tray 110. For example, the tray 110 may be formed in a single, unitary piece of rigid material by vacuum-formation, thermal molding or other technique for forming plastics or similar materials. An injection molding process may also be used to form the tray 110 and raised walls 120 in a single, unitary piece. In other embodiments, the walls 120 may simply be attached to the interior, bottom surface of the tray 110. In such embodiments, the walls 120 may all be formed in a single piece, and then that piece attached or otherwise affixed to the interior, bottom surface of the tray 110, or one or more of the walls 120 may be formed separately, and then the two or more pieces comprising the walls 120 attached or otherwise affixed to the interior, bottom surface of the tray 110. Furthermore, although this illustrated embodiment of the package 100 includes walls 120 that form four compartments on the tray 110, it is understood that a package designed and constructed in accordance with the disclosed principles may include walls that form any number of compartments on the tray 110 for holding product(s), such as only one wall dividing two compartments or as many walls as needed to create as many compartments as desired. Moreover, it should be noted that while the four compartments created on the tray 110 of FIGS. 1 and 2 are of substantially equal dimensions and sizes, compartments formed on the tray of a package in accordance with the disclosed principles may of any size and shape with respect to one another, and no limitation to any particular size or shape of the compartments is implied or should be inferred.

Still further, the dimensions and slope of the walls 120 can be different from those in this illustrated embodiment. For example, in this embodiment of the package 100, the walls 120 not only have a thickness that tapers upwardly, where the base of each wall 120 is thicker than the top of each wall 120, but the walls 120 also have a taper as you move from the center of the tray 110 to the periphery of the tray 110. The upward tapering of the shape of the walls 120 is typical for those trays and walls manufactured using vacuum forming or injection molding, but may also be so tapered as an ornamental feature. This slight tapering, as well as the illustrated hollow structure of the walls 120, also assists with both strength of the walls as well as with nesting or stacking trays having such tapered wall formation. Also, the overall thicknesses of the walls 120, whether at the top or bottom of a wall 120, or at the center-most or outer-most portion of a wall 120, can be selected as desired for each application. And similarly, the angle of the slope of each wall 120, when moving from the center of the tray 110 to the periphery of the tray 110 may also be different from the illustrated embodiment. Such sloping may also be included on less than all of the walls 120, if desired, and the slope on one or more of the walls 120 may be formed as a straight line, a curved line, or as in this illustrated embodiment, as a combination of partially curved and partially straight when moving from the center to the periphery of the tray 110. Still further, the slope of the tops of the wall(s) 120 may be reversed so that they slope from the periphery of the tray 110 downward to the center of the tray 110. Of course, a combination of upwardly and downwardly sloping walls may also be employed in a package constructed in accordance with the disclosed principles.

Figure 3:
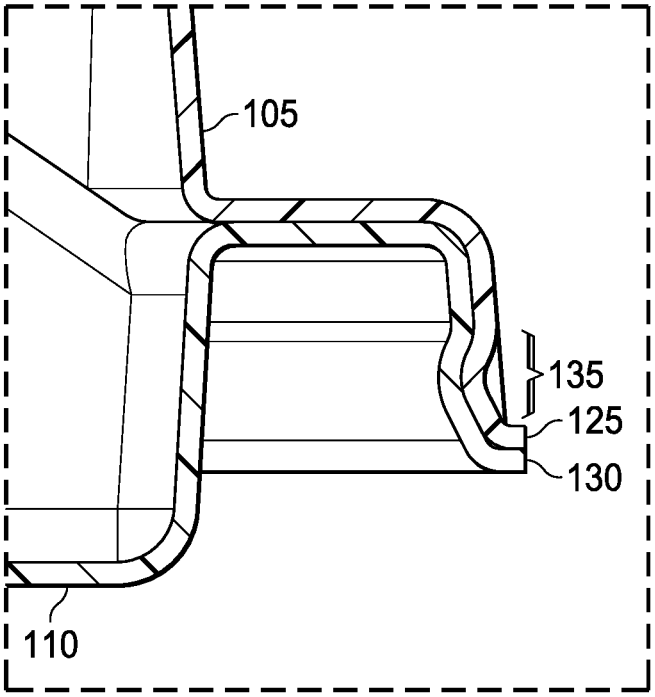
FIG. 3 illustrates a close up cross-sectional view detail view of a portion of FIG. 2, which illustrates the lid skirt joined with the tray skirt when the lid is closed onto the tray.

Also visible from the cross-sectional view of FIG. 2 are a lid skirt 125 and a tray skirt 130. Each skirt 125, 130 in this embodiment of a package 100 in accordance with the disclosed principles is formed in an outward and downward configuration. Additionally, the skirts 125, 130 are preferably formed coextensive with one another, and in corresponding complimentary shapes. Such complimentary formation of the lid skirt 125 and the tray skirt 130 allows the skirts 125, 130 to be used as a closing fastening feature for the package 100. Specifically, the lid skirt 125 may be secured over the tray skirt 130 when fitting the lid 105 onto the tray 110. The rigid materials used to form the lid 105 and the tray 110 provide a minimum amount of resiliency along with flexibility to the corresponding skirts 125, 130. This results in the skirts 125, 130 maintaining their overlapping positioning so as to keep the lid 105 snapped onto the tray 110. However, this also allows the lid skirt 125 to be flexed outwardly, away from the tray skirt 130 temporarily so that the lid 105 may be lifted off of the tray 110. The outer walls of the skirts 125, 130 may also be formed with a securing feature 135 to assist with maintaining the joining of the lid skirt 125 with the tray skirt 130. FIG. 3 is a close up cross-sectional detail view of a portion of a portion of FIG. 2, which illustrates the lid skirt 125 joined with the tray skirt 130 when the lid 105 is closed onto the tray 110. From this close up view, the complimentary, outward and downward shapes of the lid skirt 125 and the tray skirt 130 can be seen. Also, the securing feature 135, which in this embodiment of the package 100 is a concave (inward) curvature on the downward portions of the skirts 125, 130, can also be seen. The concave securing feature 135 assists in securing the lid 105 onto the tray 110 because its curvature is inward (i.e., concave) while the upper curvature of the skirts 125, 130 is in the opposite outward direction (i.e., convex). These opposing curvatures work in concert to keep the lid skirt 125 from slipping off of the tray skirt 130, thereby allowing opening and reclosing of the lid 105 and the tray 110. The lid tab **105*a* and the tray tab 110*a* may be used by the consumer to pull apart and thereby overcome the securing feature, and thus separate the lid skirt 125 from the tray skirt 130 to open the package 100**.

Figure 4:
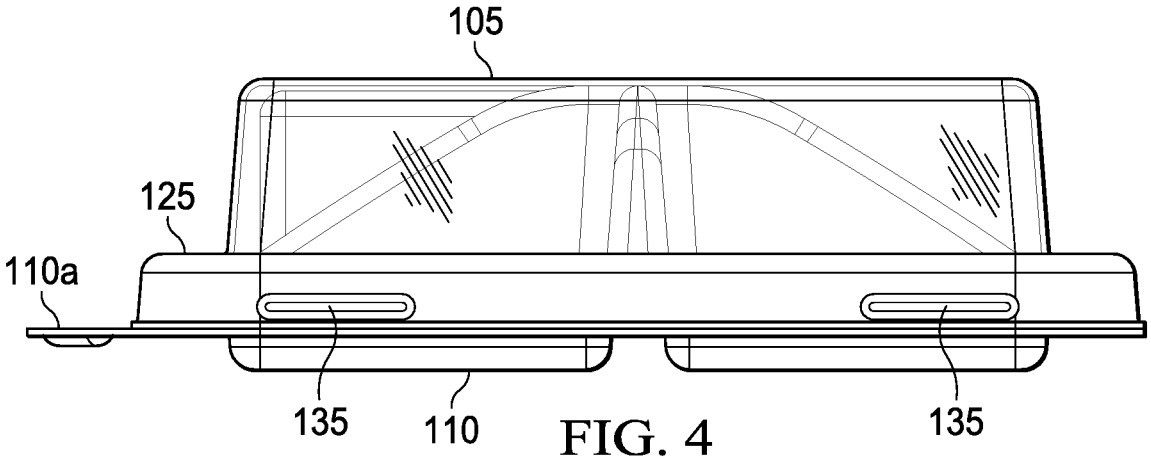
FIG. 4 illustrates a side view of the rigid multi-compartment package illustrated in FIGS. 1-3.

Looking now at FIG. 4, illustrated is a side view of the rigid multi-compartment package 100 illustrated in FIGS. 1-3. From this side view, the semi-transparent lid 105 of this embodiment of the package 100 may be seen snap-fitted over and onto the tray 110. Also seen from this side view, the height of the center portions of the walls 120 may be seen reaching up to and touching the inside upper surface of the rigid lid 105. Moreover, a portion of the product 115 held on the tray 110 may be seen exposed above portions of the walls 120, which would be visible to a potential consumer through the semi-transparent rigid lid 105. To provide the snap-fitting of the lid 105 onto the tray 110, the securing features 135 are provided on several portions of the lid and tray skirts 125, 130. From this view, the securing features 135 can be seen to comprise a plurality of corresponding lateral indentions from inwardly on the vertical portions of both the lid skirt 125 and the tray skirt 130. These capsule-shaped indentations correspond in a "spooning" fashion, one lying within the other, to secure the lid 105 onto the tray 110. Although this embodiment of the package 100 includes eight securing features 135, with two positioned on each side of the package 100, other embodiments may include a greater or lesser number of such features. Also, the securing features 135 may comprise different sizes or shapes of such coextensive features.

Figure 5:
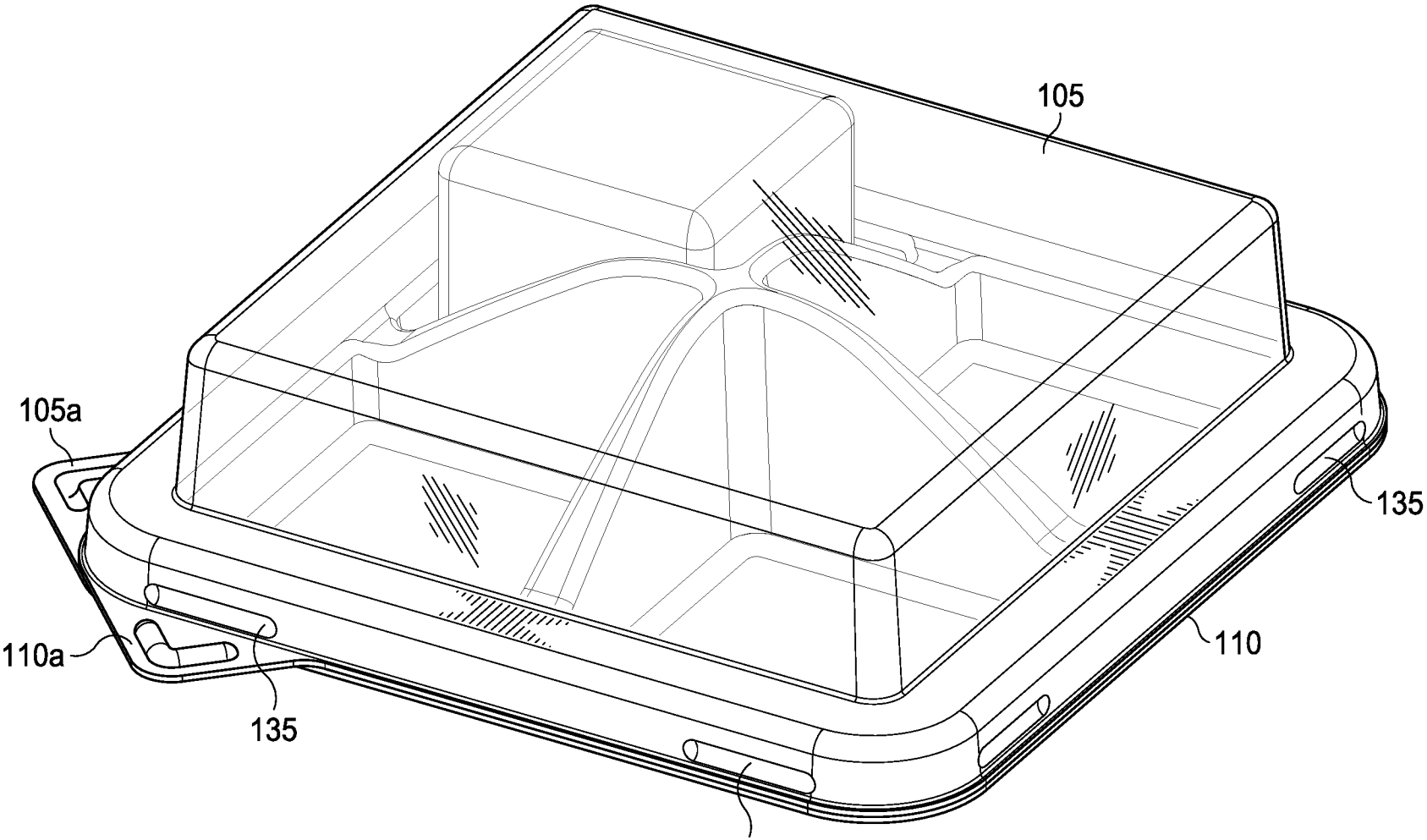
FIG. 5 illustrates an isometric view of the rigid multi-compartment package illustrated in FIGS. 1-4.

Turning to FIG. 5, illustrated is an isometric view of the rigid multi-compartment package 100 illustrated in FIGS. 1-4. From this view, the four compartments in this embodiment of the package 100 can be seen through the semi-transparent lid 105, as well as the orientation and shape of the walls 120 formed on the tray 110. Also shown from this view is how the product(s) 115 within the package 100 may be seen by potential consumers from both the side and top of the package 100. The orientation and locations of the securing features 135 on the two visible sides of the package 100 are also shown from this view.

The unique structure of the package 100 illustrated in FIGS. 1-5, as well as the embodiments discussed in detail below, offer significant advantages over conventional food product packages. For example, conventional packages typically include downwardly formed compartments in a rigid or semi-rigid tray, where the food product is placed down in the compartments. A thin, flexible film is then laid over the top surface of the conventional tray to cover the top openings of the downwardly formed compartments, and thus cover the product held within those compartments. However, the rigid tray 110 having sloping walls 120 extending upwardly, rather than the downwardly formed compartments typically found in conventional packages, permits easier visibility of the food products 115. Moreover, by employed sloping walls 120 when moving from the center of the tray 110 towards its perimeter, the product 115 held on the rigid tray 110 is easily graspable by a consumer.

Additionally, instead of the thin flexible film used in conventional packages, the disclosed principles provide packages having a rigid lid, which thus offers far better protection for the enclosed products. Moreover, the rigid lid in the disclosed packages is recloseable on to the rigid tray, which allows the unique disclosed packages to be reusable if desired. Also, the rigid material comprising the disclosed trays prevents crushing of food products as often occurs in downwardly formed compartments found in conventional packages, which are formed of thinner, less rigid materials. Still further, the upwardly formed walls of the disclosed packages may be formed as hollow walls, as shown in FIG. 2. Such hollow formed walls, combined with the raised lip 110*c* of the tray 110 having a slight taper, also as seen in FIG. 2, which allows multiple trays 110 of the same embodiment of the package 100 to be stackable/nestable. Likewise, the slight taper to the rigid lid 105, again shown in FIG. 2, allows multiple lids 105 of the same embodiment to also be stackable. Such ability to stack multiple lids and trays of a disclosed package is particularly useful if the rigid material used to construct the lids 105 and trays 110 is washable and reusable, since many packages 100 can thus be cleaned and saved for repeated use by a consumer. Furthermore, as mentioned above, the rigid tray 110 having the sloped upwardly extending walls 120 creates a unique package where the product(s) held in the tray compartments is more readily visible from the side of the package 100. The rigid lids 105 may also be formed of transparent or semi-transparent material, which also viewing of the product(s) 115 therein by consumers without having to open or even pick up the package 100. As such, packages in accordance with the disclosed principles provide for unique product displaying to the surrounding environment versus conventional snack packages, such as the conventional downwardly formed trays mentioned above, or even stand up snack bags, because the product(s) is more readily visible from the package's surroundings and because of the unique shapes of the rigid lids 105 and trays 110. All of these advantages, and even further advantages discussed below, may be achieved with all of the various embodiments of the rigid packages in accordance with the disclosed principles.

Figure 6:
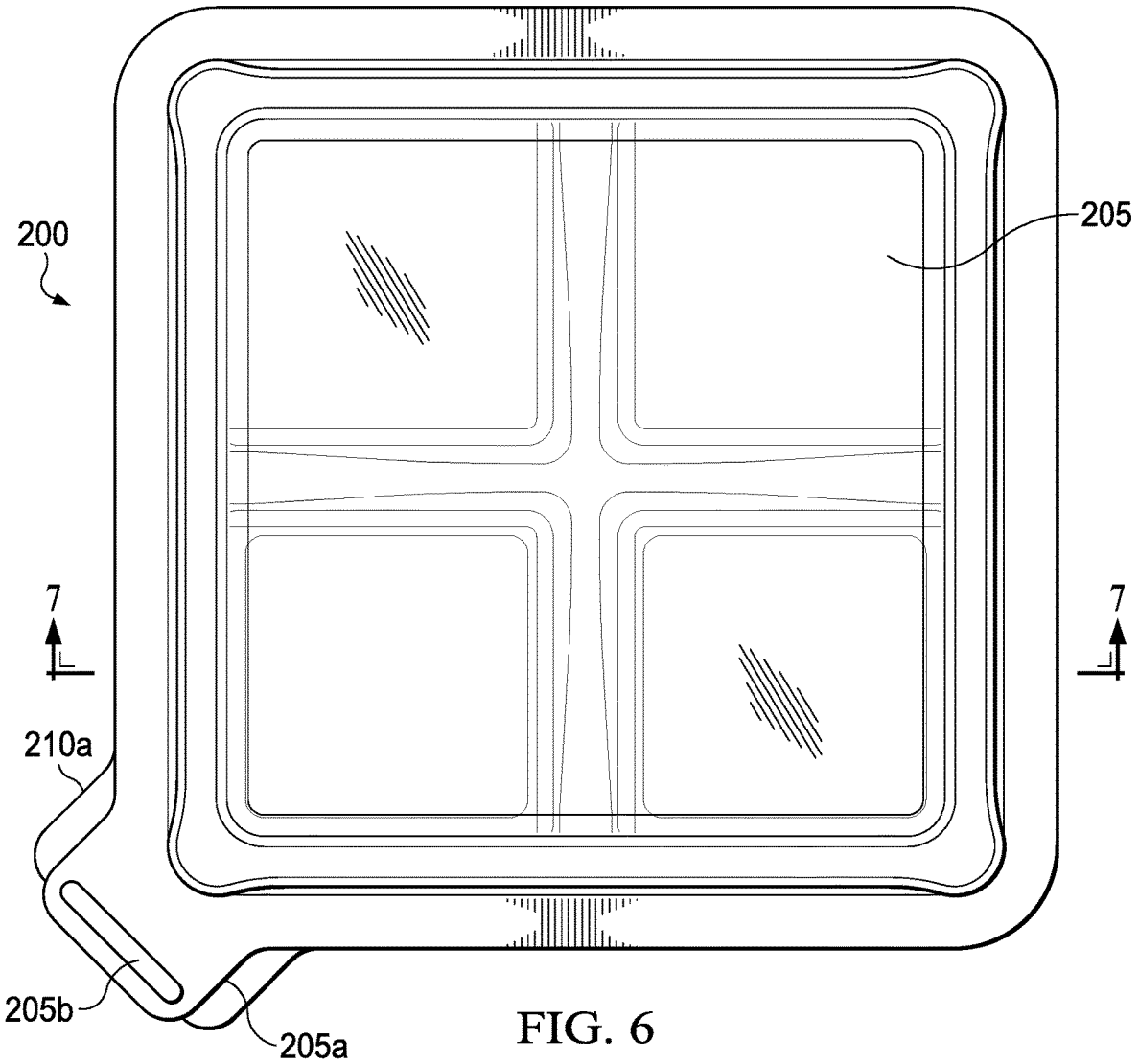
FIG. 6 illustrates a top view of a second embodiment of a rigid multi-compartment recloseable package constructed in accordance with the disclosed principles.

Referring now to FIG. 6, illustrated is a top view of a second embodiment of a rigid multi-compartment recloseable package 200 constructed in accordance with the disclosed principles. This embodiment of the package 200 is again formed having four sides, and generally in the shape of a square when viewed from the top, with the four corners of the package 200 again rounded off. The package 200 again comprises a rigid lid 205 fitted completely over a rigid tray 210. The rigid lid 205 of the package 200 is also semi-transparent in this embodiment, which as before allows visibility of a piece of product 215 being held within the package 200.

This embodiment of the package 200 again includes a lid tab 205*a* and tray tab 210*a*, which may be grasped by a consumer and pulled in opposite directions so that the lid tab 205*a* is pulled upwardly and the tray tab 210*a* is pulled downwardly to separate the lid 205 from the tray 210. A texture feature 205*b* may also be provided on the lid tabs 205*a* as before, to assist the consumer in maintaining their grasp of the tabs 205*a*, or such texture features may be provided on both the lid and tray tabs as in the embodiment discussed above.

Figure 7:
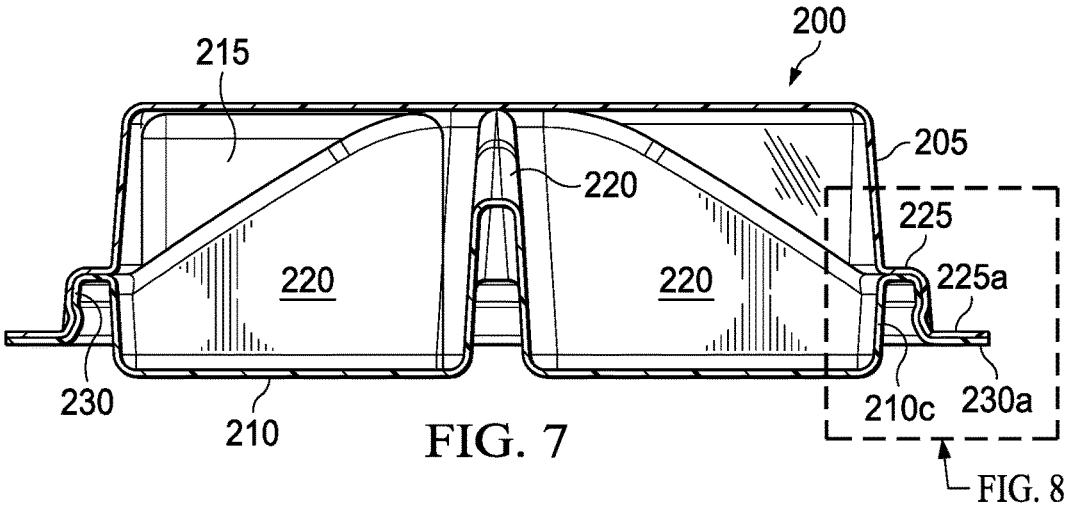
FIG. 7 illustrates a side cross-sectional view of the package of FIG. 6 taken along line 7-7.

Turning to FIG. 7, illustrated is a side cross-sectional view of the package 200 of FIG. 6 taken along line 7-7. From this cross-sectional view, both the lid 205 and the tray 210 of this embodiment of the package 200 can be seen. As before, this view again shows the uniquely shaped raised walls 220 that extend from the bottom surface of the rigid tray 210 to the underside of the lid 205 to create the multiple compartments on the tray 210.

In this embodiment, the dividing walls 220 again are tapered or sloped from the center of the tray 210 towards the outer periphery of the tray 210. The slope of the walls 220 are again such that the bottom periphery of the tray 210 includes a raised lip 210*c* that helps secure the product 215 held on the tray 210 from sliding off of the tray 210 when the lid 205 is removed. This tapered structure for the walls 220 again permits partial viewing of the product 215 within the package 200 from the side by a consumer in those embodiments having a transparent or semi-transparent lid 205. As also mentioned above, the sloped walls 220 allow easier grasping of the product 215 on the tray 210 by a consumer's fingertips once the lid 205 is removed from the tray 210.

Formation of the walls 220 and the tray 210 can again be done in a single, unitary piece of rigid material by any viable plastic formation technology, or the walls 220 may simply be attached to the interior, bottom surface of the tray 210. In such latter embodiments, the walls 220 may all be formed in a single piece, and then that piece attached or otherwise affixed to the interior, bottom surface of the tray 210, or one or more of the walls 220 may be formed separately, and then the two or more pieces comprising the walls 220 attached or otherwise affixed to the interior, bottom surface of the tray 210. As with the package embodiment of FIGS. 1 and 2, this embodiment of the package 200 may include walls 220 that form any number of compartments on the tray 210 for holding product(s) 215. And it should be noted that while the four compartments created on the tray 210 of FIGS. 6 and 7 are of substantially equal dimensions and sizes, compartments formed on the tray of a package in accordance with the disclosed principles may of any size and shape with respect to one another, and no limitation to any particular size or shape or even the number of compartments is implied or should be inferred.

Similarly, the dimensions and slope of the walls 220 can also as before be different from those in this illustrated embodiment. Thus, the package 200 has walls 220 may not only have a thickness that tapers upwardly, where the base of each wall 220 is thicker than the top of each wall 220, but also have a taper as you move from the center of the tray 210 to the periphery of the tray 210. The overall thicknesses of the walls 220, whether at the top or bottom of a wall 220, or at the center-most or outer-most portion of a wall 220, can again be selected as desired for each application, as may the number, angle and line of the slope of each wall 220.

Also in this embodiment of the package 200 are a lid skirt 225 and a tray skirt 230 to be used as a closing feature for the package 200, in the manner discussed above for the prior embodiment, and are again each formed in an outward and downward configuration and coextensive with one another in corresponding complimentary shapes. However, this embodiment of the package 200 differs from that of FIGS. 1 and 2 in that the ends of the skirts 225, 230 each further include a flange 225*a*, 230*a* laterally extending outward from the bottom ends of each skirt 225, 230. The flanges 225*a*, 230*a*, in this embodiment, are formed coextensive with one another, and may be used create a seal for the package 200 that may be pealed apart by the consumer. It should be noted that while the illustrated flanges 225*a*, 230*a* are formed horizontally coextensive, in other embodiments either the lid or tray flange may be formed laterally extending beyond the other, if desired, which can assist with separating the flanges when opening of the package is desired. The formation of such a seal using the flanges 225*a*, 230*a*, which is discussed in co-owned U.S. patent application Ser. No. 15/802,561 (Patent Application Publication US 2019/0135520), the disclosure of which is hereby incorporated by reference, can be provided at the factory packaging the products 215 for sale in the package 200, and thus permits the package 200 to hold any of the types of food products requiring hermetic sealing. Also, in this embodiment, the flanges 225*a*, 230*a* extend horizontally from their corresponding skirts 225, 230; however, the disclosed principles are not so limited. Thus, similar flanges 225*a*, 230*a* may be formed to extend in other directions as well. Moreover, although the flanges 225*a*, 230*a* are flat in this embodiment, a package in accordance with the disclosed principles may also include flanges 225*a*, 230*a* having a different shape, such as curved in either an upward or downward direction.

Figure 8:
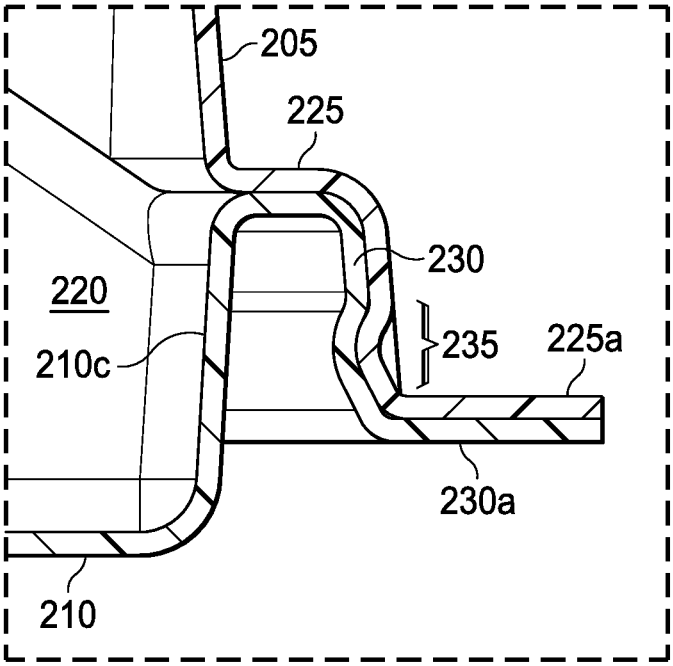
FIG. 8 illustrates a close up cross-sectional view detail view of a portion of FIG. 7.

Turning briefly to FIG. 8, illustrated is a close up cross-sectional detail view of a portion of FIG. 7. This close up view illustrates the joined lid and tray skirts 225, 230 joined together when the lid 205 is closed onto the tray 210. From this close up view, the complimentary, outward and downward shapes of the lid skirt 225 and the tray skirt 230 can be seen. Thus, as before, the rigid materials used to form the lid 205 and the tray 210 provide a minimum amount of resiliency along with flexibility to the corresponding skirts 225, 230. This results in the skirts 225, 230 maintaining their overlapping positioning so as to keep the lid 205 snapped onto the tray 210. However, this also allows the lid skirt 225 to be flexed outwardly, away from the tray skirt 230 temporarily so that the lid 205 may be lifted off of the tray 210. Also, securing feature 235, which in this embodiment are again formed as corresponding concave curvatures on the downward portions of the skirts 225, 230, can also be seen. As discussed above, these securing features 235 assist in securing the lid 205 onto the tray 210. To open the package 200, the lid tab 205*a* and the tray tab 210*a* may be pulled apart by the consumer to overcome the securing features 235 and thus separate the lid skirt 225 from the tray skirt 230 to open the package 200. Of course, other shapes for securing features on the package 200 may also be employed.

Figure 9:
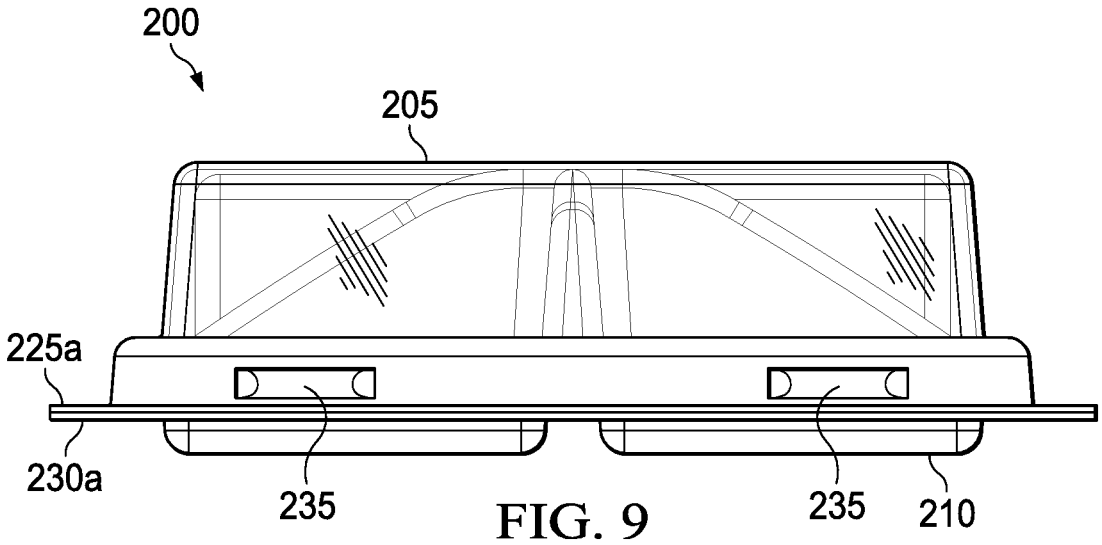
FIG. 9 illustrates a side view of the rigid multi-compartment package illustrated in FIGS. 6-8.

Looking now at FIG. 9, illustrated is a side view of the rigid multi-compartment package 200 illustrated in FIGS. 6-8. From this side view, the semi-transparent lid 205 of this embodiment of the package 200 is shown snap-fitted over and onto the tray 210. Also seen from this side view, the height of the center portions of the walls 220 may be seen again reaching up to and touching the inside upper surface of the rigid lid 205, although as before, the walls 220 may be provided at different heights as well. A portion of the product 215 held on the tray 110 may also be seen exposed above portions of the walls 220, which would be visible to a potential consumer from a side viewing of the package 200 through the semi-transparent rigid lid 205. To provide the snap-fitting of the lid 205 onto the tray 210, the securing features 235 are provided on several portions of the lid and tray skirts 225, 230 around the perimeter of the package 200. From this view, the elongated capsule shape of the securing features 235 can be seen, which are provided on several areas of both the lid skirt 225 and the tray skirt 230. As described above, these capsule-shaped indentations correspond to secure the lid 205 onto the tray 210. Although this embodiment of the package 200 again includes eight securing features 235, with two positioned on each side of the package 200, other embodiments may again include a greater or lesser number of such features 235. Also, the securing features 235 may comprise different sizes or shapes of such coextensive and corresponding features formed on the skirts 225, 230.

Figure 10:
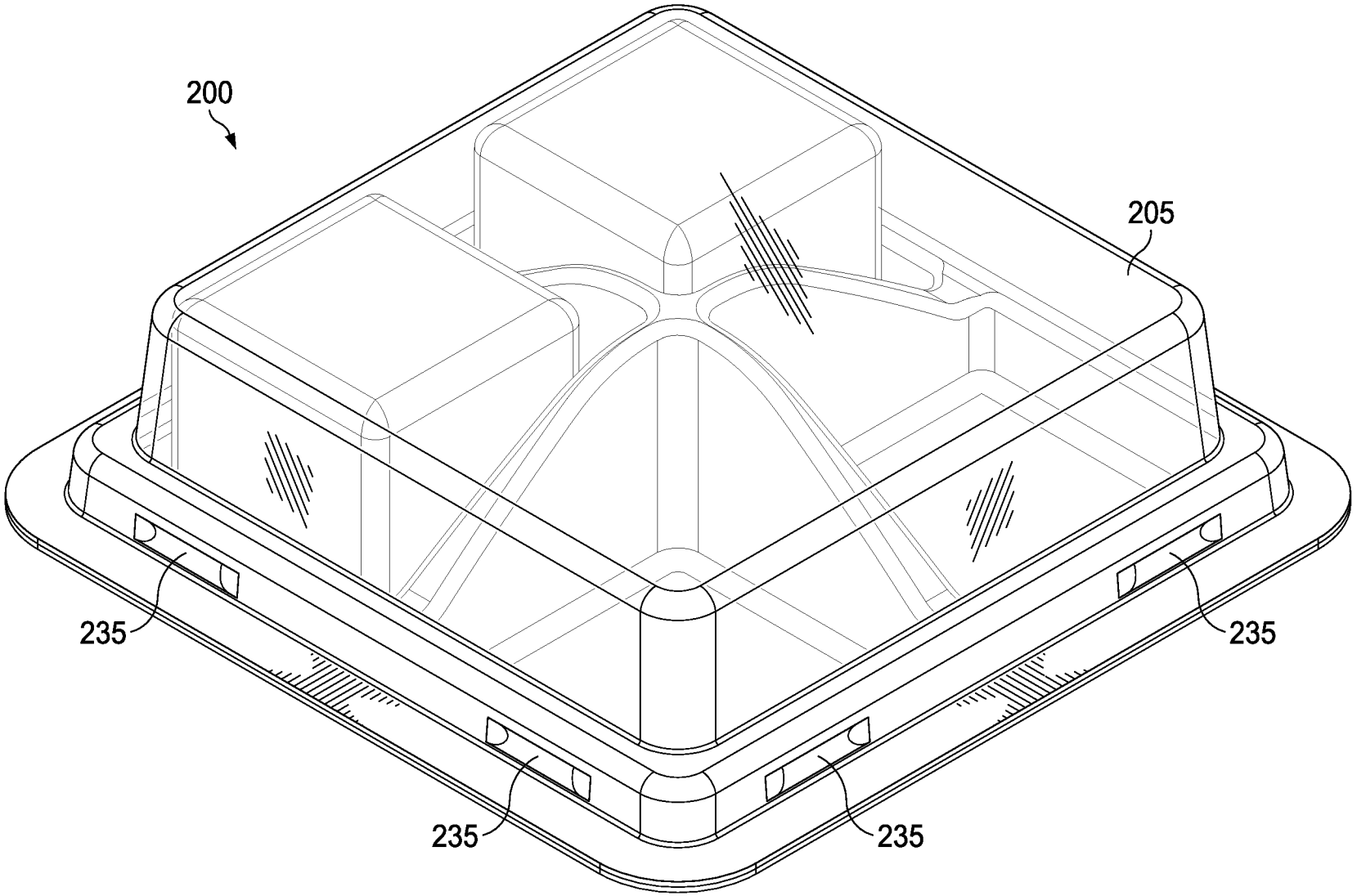
FIG. 10 illustrates an isometric view of the rigid multi-compartment package illustrated in FIGS. 6-9.

Turning to FIG. 10, illustrated is an isometric view of the rigid multi-compartment package 200 illustrated in FIGS. 6-9. From this view, the four compartments in this second embodiment of the package 200 can be seen through the semi-transparent lid 205, as well as the orientation and shape of the walls 220 formed on the tray 210. As before, this view illustrates how the product(s) 215 within the package 200 may be seen by potential consumers from both the side and top of the package 200. The orientation and locations of the securing features 235 on the two visible sides of the package 200 are also shown from this view.

Figure 11:
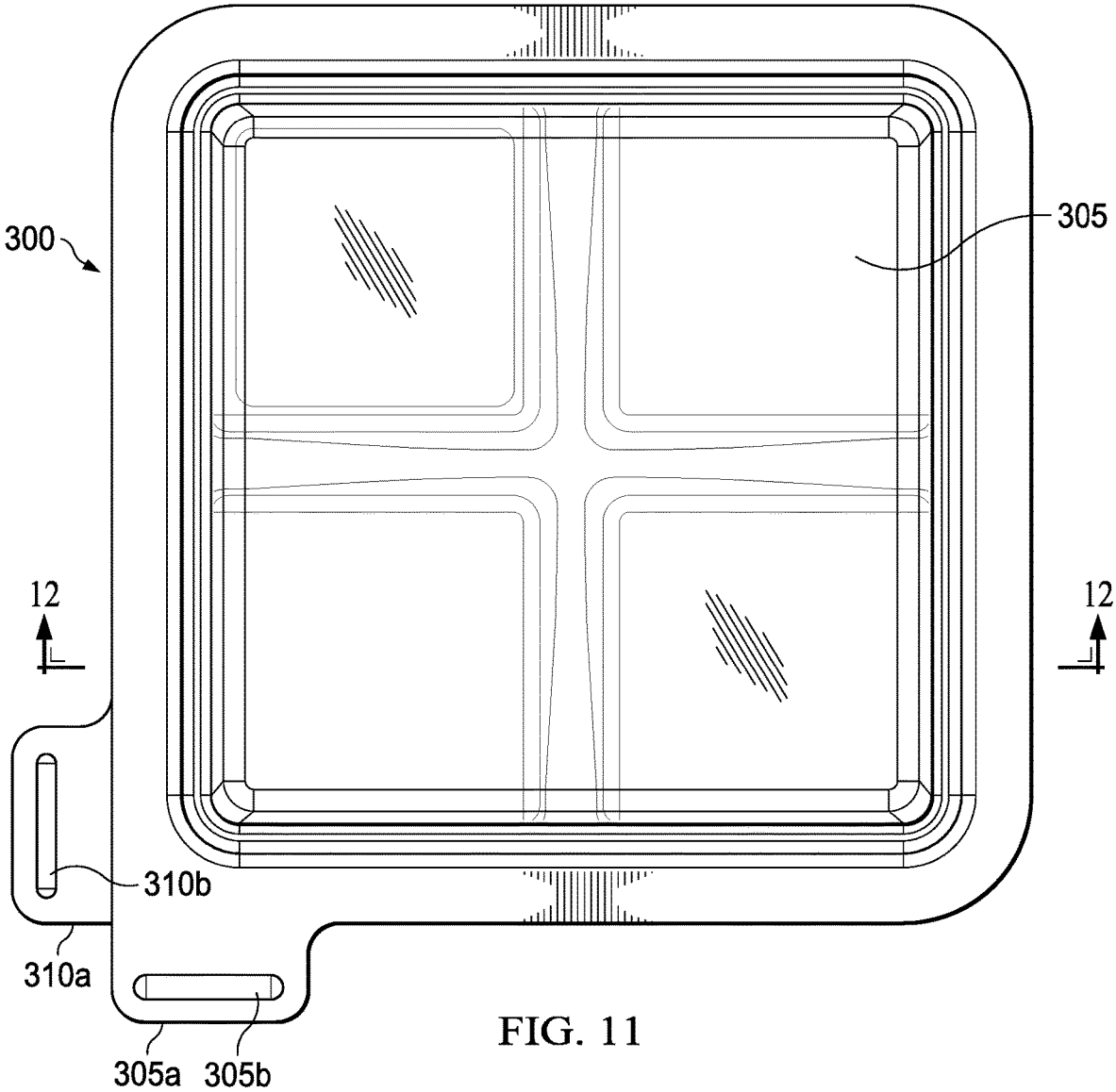
FIG. 11 illustrates a top view of a third embodiment of a rigid multi-compartment recloseable package constructed in accordance with the disclosed principles.

Referring now to FIG. 11, illustrated is a top view of a third embodiment of a rigid multi-compartment recloseable package 300 constructed in accordance with the disclosed principles. This embodiment of the package 300 is again formed having four sides, and generally in the shape of a square when viewed from the top, with the four corners of the package 300 again rounded off. The package 300 again comprises a rigid lid 305 fitted completely over a rigid tray 310. The rigid lid 305 of the package 300 is again semi-transparent in this third embodiment, which as before allows visibility of a piece of product 315 being held within the package 300.

This embodiment of the package 300 again includes a lid tab 305*a* and tray tab 310*a*, which may be grasped by a consumer and pulled in opposite directions so that the lid tab 305*a* is pulled upwardly and the tray tab 310*a* is pulled downwardly to separate the lid 305 from the tray 310. However, this embodiment of the tabs 305*a*, 310*a* are formed in a rectilinear shape, whereas a triangular shape was used in the prior package embodiments discussed above. Texture features 305*b* and 310*b* may again be provided on the respective tabs 305*a*, 310*a* as before, to assist the consumer in maintaining their grasp of the tabs 305*a*, 310*a*. In this embodiment, the rectangular shape of the tabs 305*a*, 310*a* permits an elongated shape for the texture features 305*b*, 310*b*, whereas in prior package embodiments, the features were formed in an angular shape corresponding to the triangular shape of the prior texture features.

Figure 12:
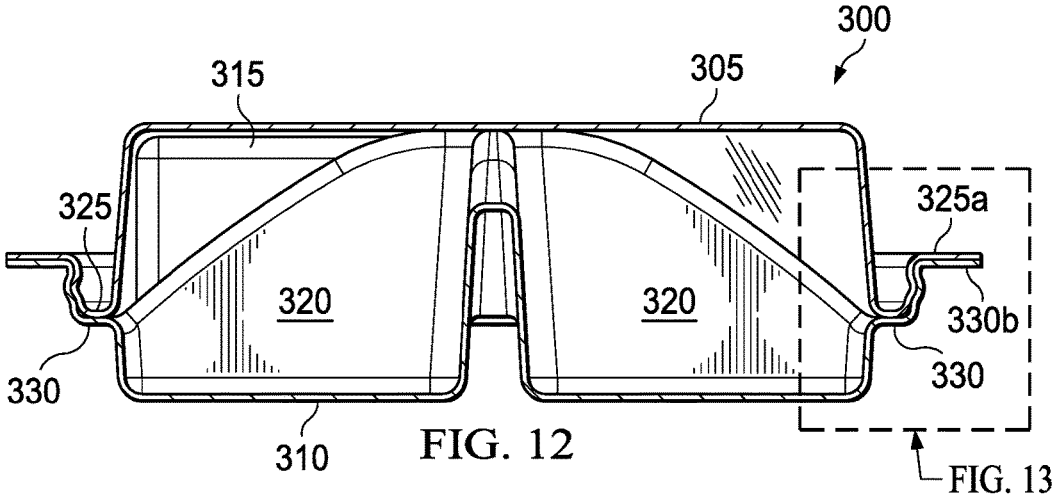
FIG. 12 illustrates a side cross-sectional view of the package of FIG. 11 taken along line 12-12.

Turning to FIG. 12, illustrated is a side cross-sectional view of the package 300 of FIG. 11 taken along line 12-12.

From this cross-sectional view, both the lid 305 and the tray 310 of this embodiment of the package 300 can be seen. As before, this view again shows the uniquely shaped raised walls 320 that extend from the bottom surface of the rigid tray 310 to the underside of the lid 305 to create the multiple compartments on the tray 310. As before, while four product compartments are again provided by the walls 320 in this embodiment, any number of compartments for the package 300 may also be provided within the scope of the disclosed principles.

In this embodiment, the dividing walls 320 again are tapered or sloped from the center of the tray 310 towards the outer periphery of the tray 310. The slope of the walls 320 are again such that the bottom periphery of the tray 310 includes a raised lip 310*c* that helps secure the product 315 held on the tray 310 from sliding off of the tray 310 when the lid 305 is removed. This tapered structure for the walls 320 again permits partial viewing of the product 315 within the package 300 from the side by a consumer in those embodiments having a transparent or semi-transparent lid 305. As also mentioned above, the sloped walls 320 allow easier grasping of the product 315 on the tray 310 by a consumer's fingertips once the lid 305 is removed from the tray 310.

Formation of the walls 320 and the tray 310 can again be done in a single, unitary piece of rigid material by any viable plastic formation technology, or the walls 320 may simply be attached to the interior, bottom surface of the tray 310. In such latter embodiments, the walls 320 may all be formed in a single piece, and then that piece attached or otherwise affixed to the interior, bottom surface of the tray 310, or one or more of the walls 320 may be formed separately, and then the two or more pieces comprising the walls 320 attached or otherwise affixed to the interior, bottom surface of the tray 310. As mentioned above, the walls 320 maybe be formed to provide any number of compartments on the tray 310 for holding product(s) 315, as well as that the compartments created on the tray 310 can be or substantially equal dimensions and sizes, or may be formed in any size and shape with respect to one another. Similarly, the dimensions and slope of the walls 320 can also as before be different from those in this illustrated embodiment, in the same manner as discussed above for the prior embodiments of package constructed in accordance with the disclosed principles.

Also once again included again in this embodiment of the package 300 are a lid skirt 325 and a tray skirt 330 to be used as a closing feature for the package 300, in the manner discussed above for the prior embodiment. However, in this embodiment of the package 300, the skirts 325, 330 are now shown as being formed in an outward and upward configuration and coextensive with one another in corresponding complimentary shapes. Despite having skirts 325, 330 that are formed upwardly, this embodiment of the package 300 again includes a flange 325*a*, 330*a* laterally extending outward from the ends of each skirt 325, 330, similar to the package 200 of FIGS. 6-10. The flanges 325*a*, 330*a* in this embodiment are again formed coextensive with one another, and may be used create a seal for the package 300 that may be pealed apart by the consumer. The formation of such a seal using the flanges 325*a*, 330*a*, as mentioned above, allows the package 300 to be used for any of the types of food products requiring hermetic sealing. Also as before, the flanges 325*a*, 330*a* in this embodiment are flat and extend horizontally from their corresponding skirts 325, 330; however, they may also be formed extending in other directions as well, and may be formed having a shape other than flat.

Figure 13:
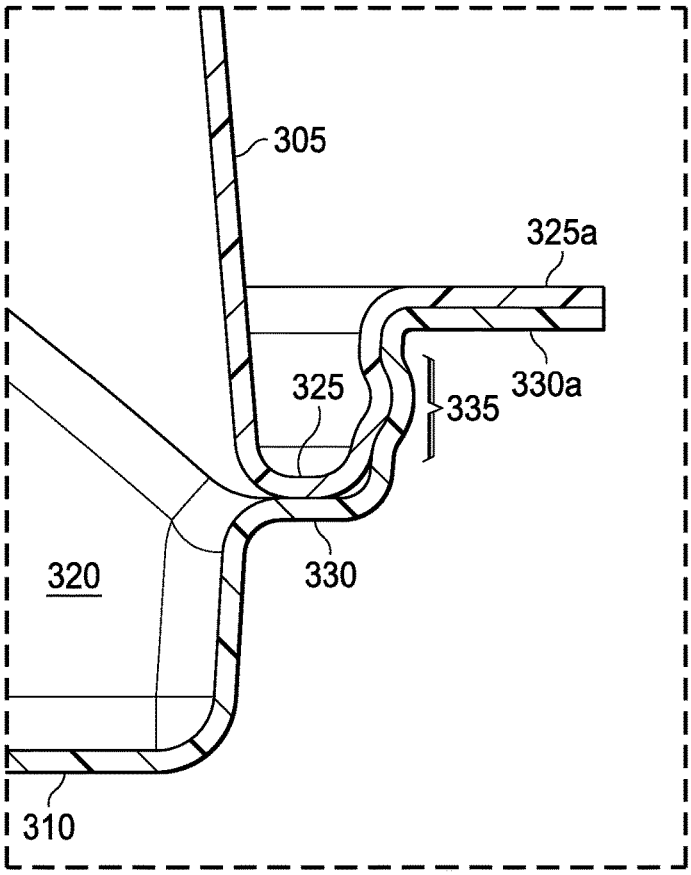
FIG. 13 illustrates a close up cross-sectional view detail view of a portion of FIG. 12.

FIG. 13 illustrates a close up cross-sectional detail view of a portion of FIG. 12. This close up view illustrates the joined lid and tray skirts 325, 330 joined together when the lid 305 is closed onto the tray 310. From this close up view, the complimentary, outward and now upwardly formed shapes of the lid skirt 325 and the tray skirt 330 can be seen clearly. As before, the lid skirt 225 may be secured over the tray skirt 330 when fitting the lid 305 onto the tray 310. Also as before, the rigid materials used to form the lid 305 and the tray 310 provide a minimum amount of resiliency along with flexibility to the corresponding skirts 325, 330. This results in the skirts 325, 330 maintaining their overlapping positioning so as to keep the lid 305 snapped onto the tray 310. However, in this embodiment the small amount of flexibility in the materials allows the lid skirt 325 to be flexed inwardly, away from the tray skirt 330 temporarily so that the lid 305 may be lifted off of the tray 310. Also, a securing feature 335 may also be seen on the package 300; however, in this embodiment, the securing feature 335 is formed as corresponding convex (outward) curvatures on the upward, vertical portions of the skirts 325, 330. While this securing features 335 again assists in securing the lid 305 onto the tray 310, this embodiment of the securing feature 335 is provided as a single set of corresponding curved features that are formed around the entire skirts 325, 330 of the lid 305 and tray 310. Opening the securing feature 335, however, is similar to other embodiments in that the lid tab 305*a* and the tray tab 310*a* may be pulled apart by the consumer to overcome the securing feature 335 and thus separate the lid skirt 325 from the tray skirt 330 to open the package 300. Of course, other shapes for such a securing feature 335 that circumscribes the skirts 325, 330 of the package 300 may also be employed.

Figure 14:
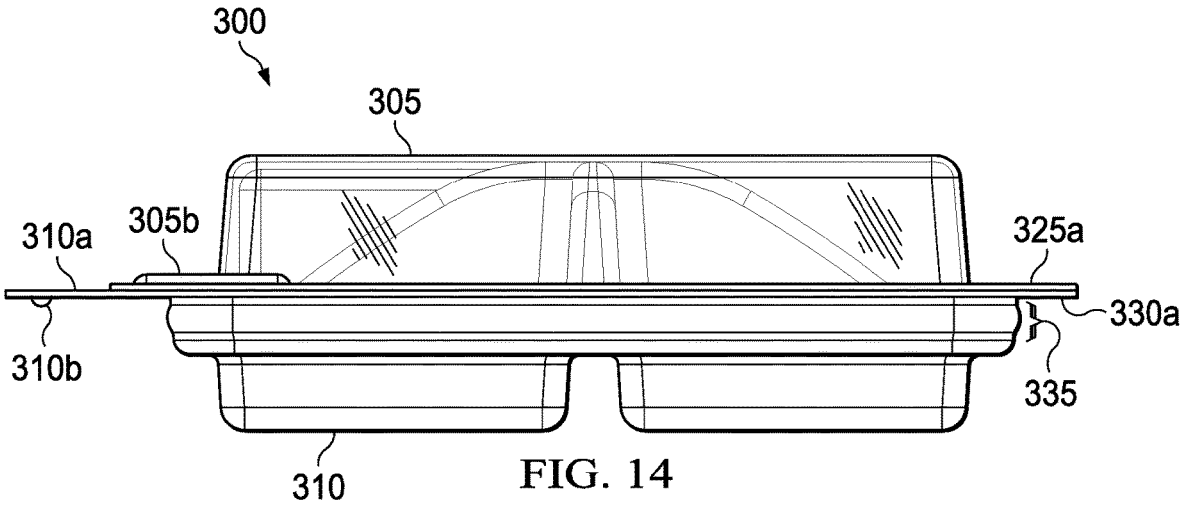
FIG. 14 illustrates a side view of the rigid multi-compartment package illustrated in FIGS. 11-13.

Looking now at FIG. 14, illustrated is a side view of the rigid multi-compartment package 300 illustrated in FIGS. 11-13. From this side view, the semi-transparent lid 305 of this embodiment of the package 300 is shown snap-fitted over and onto the tray 310. Also seen from this side view, the height of the center portions of the walls 320 may be seen again reaching up to and touching the inside upper surface of the rigid lid 305, although as before, the walls 320 may be provided at different heights as well. A portion of the product 315 held on the tray 110 may also be seen exposed above portions of the walls 320, which would be visible to a potential consumer from a side viewing of the package 300 through the semi-transparent rigid lid 305. To provide the snap-fitting of the lid 305 onto the tray 310, the securing features 335 can be seen being formed all the way around the lid and tray skirts 325, 330 of the package 300. Although this embodiment of the package 300 includes only a single securing feature 335 form around the perimeter of the skirts 325, 330, other embodiments may include two or more such features 335. Also, the securing features 335 may be comprise of a combination of the illustrated securing feature 335 along with one or more other features, such as the capsule shaped securing features of the prior discussed packages 100, 200.

Figure 15:
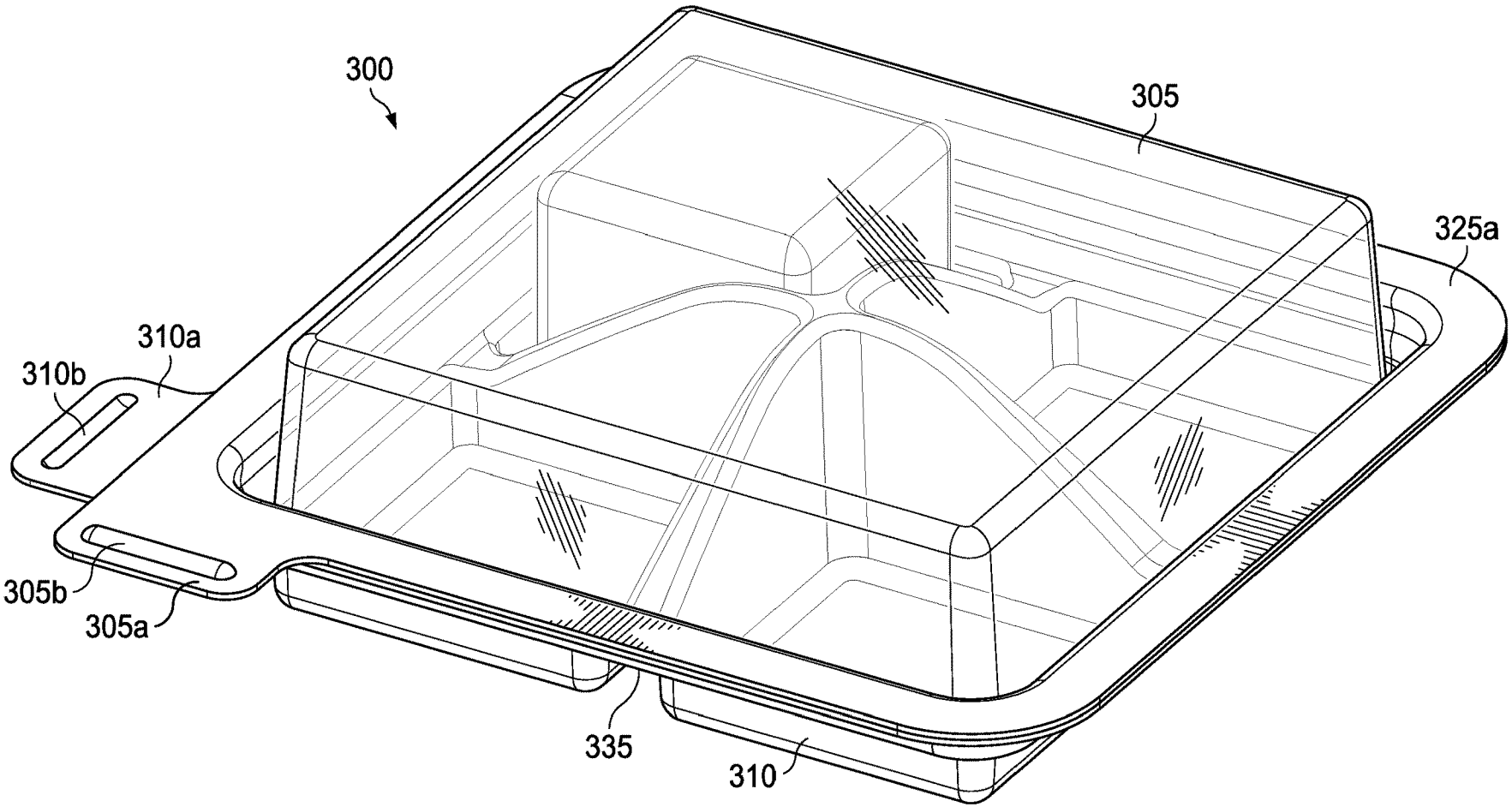
FIG. 15 illustrates an isometric view of the rigid multi-compartment package illustrated in FIGS. 11-14.

Turning to FIG. 15, illustrated is an isometric view of the rigid multi-compartment package 300 illustrated in FIGS. 11-14. From this view, the four compartments in this third embodiment of the package 300 can be seen through the semi-transparent lid 305, as well as the orientation and shape of the walls 320 formed on the tray 310. As before, this view illustrates how the product(s) 315 within the package 300 may be seen by potential consumers from both the side and top of the package 300 due to the transparent or semi-transparent rigid lid 305. The orientation and location of perimeter securing feature 335 on the two skirts 325, 330 of the package 300 is also shown from this view. The sealed flanges 325*a*, 330*a* horizontally extending from the lid 305 and tray 310 may also be seen, although as discussed above, these flanges 325*a*, 330*a* may also be formed to extend in other directions, while still falling within the breadth and scope of the present disclosure.

Figure 16:
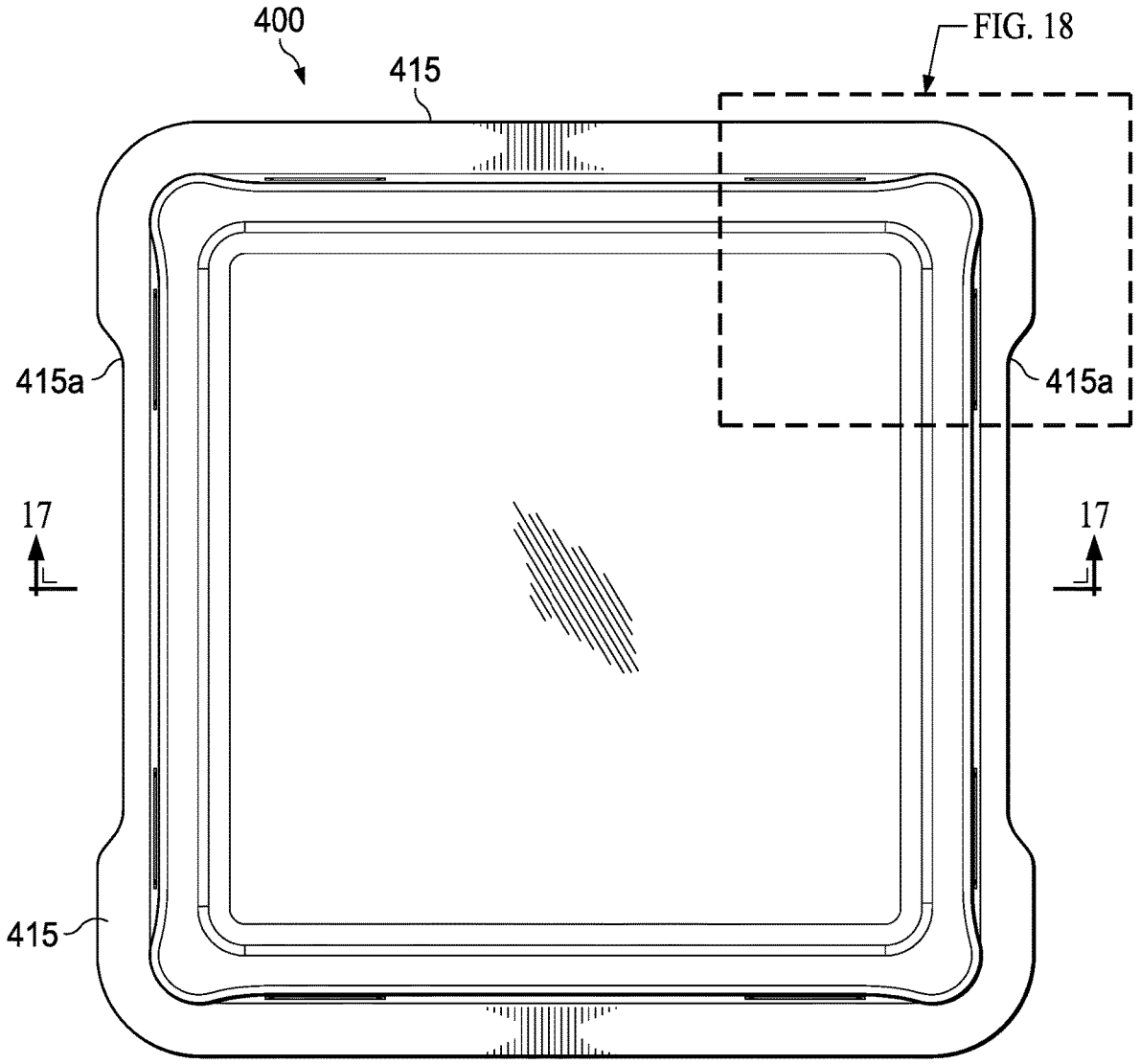
FIG. 16 illustrates a top view of yet another embodiment of a rigid lid of a recloseable package constructed in accordance with the disclosed principles.
Figure 17:
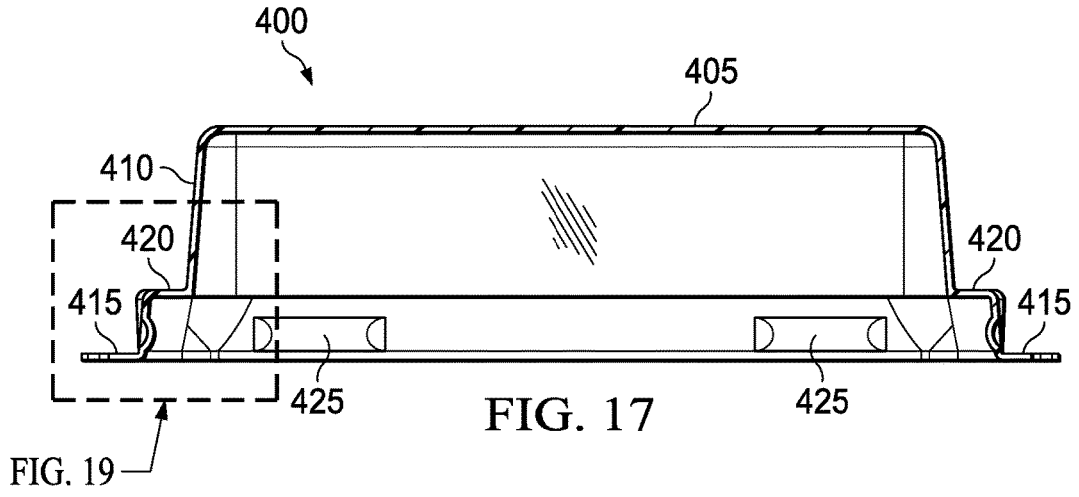
FIG. 17 illustrates a side cross-sectional view of the rigid lid of FIG. 16 taken across line 17-17.

Referring now to FIG. 16, illustrated is a top view of yet another embodiment of a rigid lid 400 of a recloseable package constructed in accordance with the disclosed principles. In addition, FIG. 17 illustrates a side cross-sectional view of the rigid lid of FIG. 16 taken across line 17-17. As with other embodiment, the rigid lid 400 in this embodiment again includes a dome, which is again a square-shaped dome, comprised of top surface 405 and at least one sidewall 410. As a square-shaped dome, the lid 400 includes four sidewalls 410 with rounded corners 410*a* joining the sidewalls 410 and the top surface 405 integrally formed with the top edges of the sidewalls 410.

In addition, the rigid lid 400 includes a lid flange 415 laterally extending outwardly from a lid skirt 420. The lid skirt 420 extends outwardly and then downward from the bottom edges of the sidewalls 410, and again extends around the perimeter of the lid 400. The lid flange 415 then extends outwardly from the bottom edge of the downward portion of the lid skirt 420. Also, as seen from the top view of FIG. 16, the lid flange 415 in this embodiment of the package includes an inset portion 415*a* on two, opposing portions of the lid flange 415. As shown, the inset portion 415*a* longitudinally extend along substantial portions of the lid flange 415 on two sides of the lid 400. Functionality of the these inset portions 415*a* is discuss further below, with reference to the corresponding rigid tray of this embodiment of the package.

Figure 18:
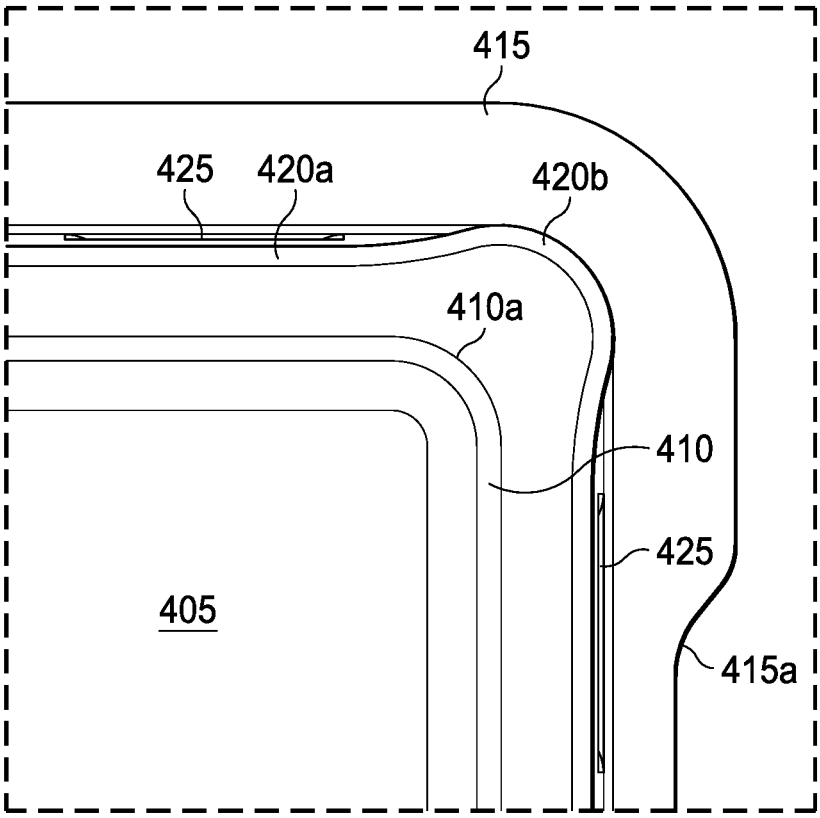
FIG. 18 illustrates a close up detail view of a portion of the rigid lid of FIG. 16.

Turning now to FIG. 18, illustrated is a close up detail view of a portion of the rigid lid 400 of FIG. 16. This close up view is a top view of one of the corner areas of the square-shaped rigid lid 400 of this embodiment. From this detailed view, a portion of the top surface 405 may be seen, as well as portions of two adjoining sidewalls 410. The rounded corner 410*a* joining these sidewalls 410 can also be seen. In addition, a portion of the lid flange 415 may be seen along with a round corner of the flange 415 in this embodiment of the lid 400. A portion of the one of the flange inset portion 415*a* is also visible from this view. Two lid securing features 425, which are discussed further below, may also be seen in this detail view.

Also visible in FIG. 18, indented portions 420*a* of the downwardly formed lid skirt 420 have been formed. More specifically, the indented portions 420*a* of the skirt 420 can be seen as slightly tapered inward from the rounded corners 420*b* in this embodiment. Such rounded corners 420*b* combined with the indented portions 420*a* of the skirt 420 having a different inward taper can increase the structural strength and stability of the rigid dome lid 400. Moreover, providing the illustrated larger radii for the rounded corners 420*b* (larger as compared to the radii the corners would have if they were formed with the same inward taper as the indented portions 420*a* of the skirt 420) assists with the nesting or stacking of multiple lids 400. For example, the larger rounded corners 420*b* not only permit easier separation of nested lids, but also provides added stability for a larger stack of many nested lids.

Figure 19:
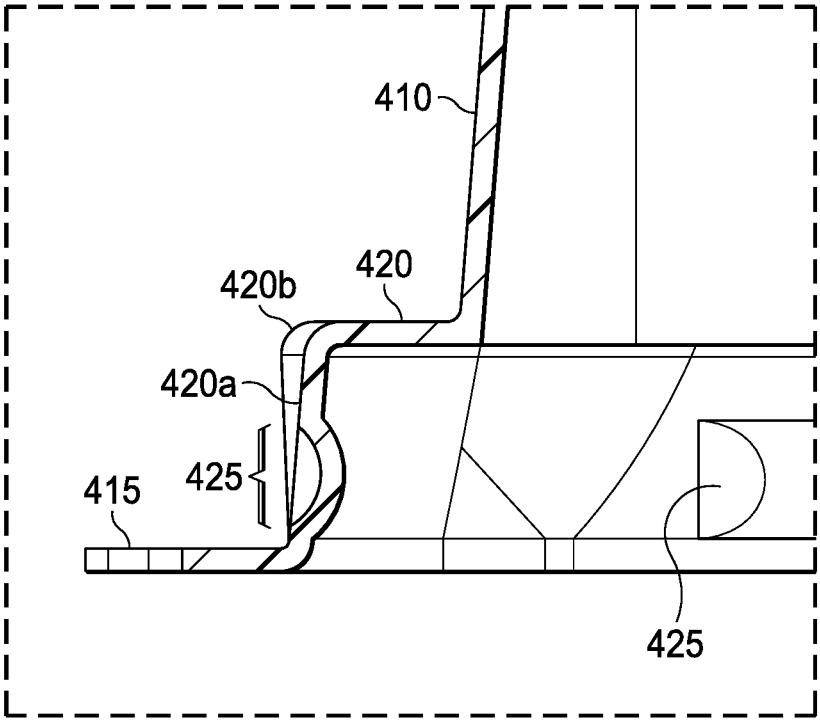
FIG. 19 illustrates a close up detail view of a portion of the rigid lid of FIG. 17.

FIG. 19 illustrates a close up detail view of a portion of the rigid lid 400 of FIG. 17. From this close up view, a profile of the lid skirt 420 and the laterally extending lid flange 415 can easily be seen. Also, the indented taper of the downward portion 420*a* of the skirt 420 can be seen from this profile view, as well as the rounded corners 420*b* of the skirt 420 having less taper than the indented portions 420*a*. Additionally, this view illustrates the lid component of a securing feature 425 of the package, for securing the lid 400 onto a rigid tray. In this embodiment, the securing feature 425 is again formed as a concave curvature on the downward portions 420*a* of the lid skirt 420. The portion of the securing feature 425 on the tray is discussed in detail below.

Figure 20:
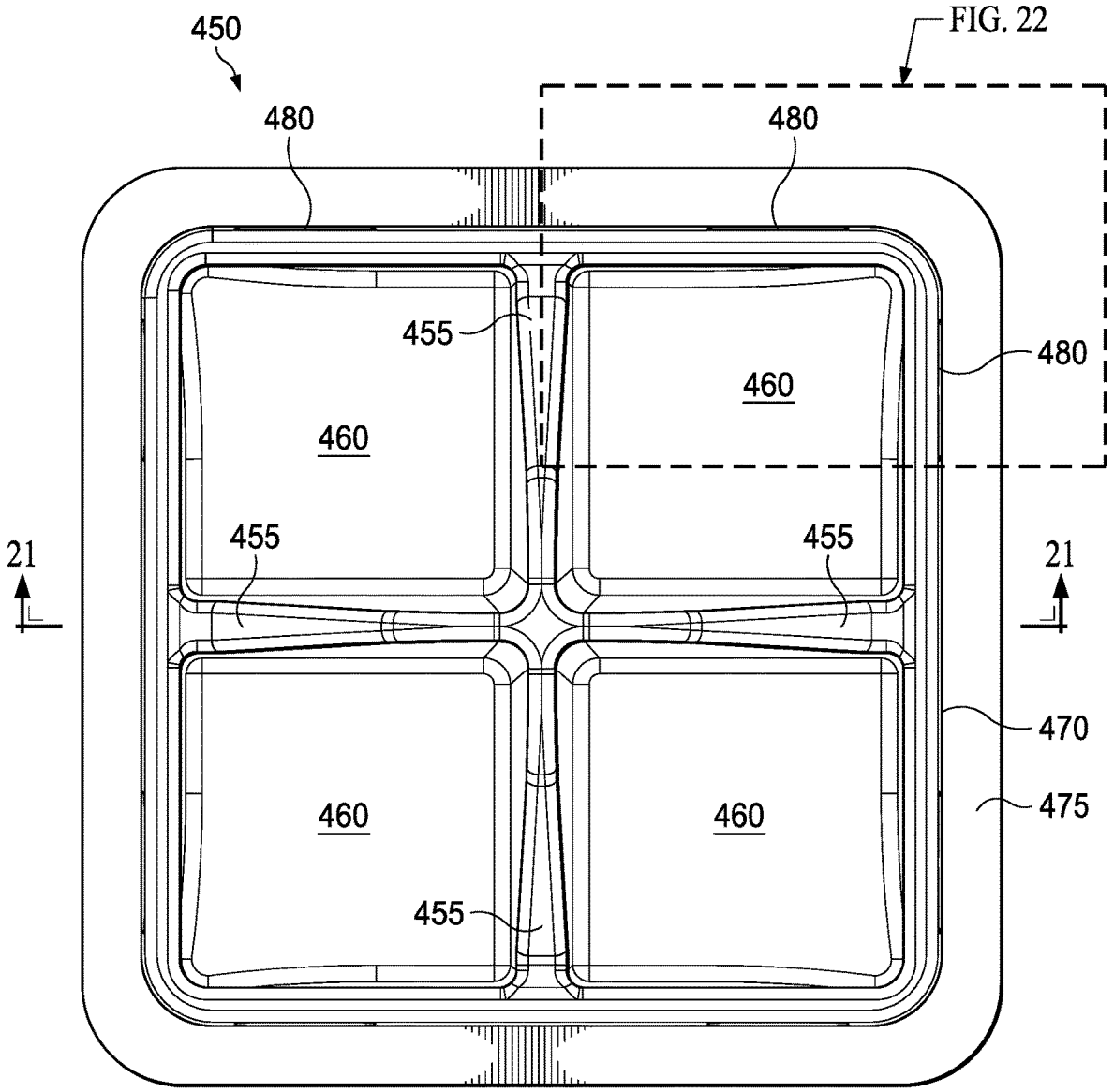
FIG. 20 illustrates a top view of a rigid tray corresponding to the rigid lid of FIGS. 16-19.

Looking now at FIG. 20, illustrated is a top view of a rigid tray 450 corresponding to the rigid lid 400 of FIGS. 16-19 for this embodiment of a package according to the disclosed principles. From this view of the rigid tray 450, the integrally formed vertical dividing walls 455 can be seen. In this embodiment, the tray 450 includes four dividing walls 455 outwardly extending from the center of the tray 450 and aligned perpendicularly.

With this formation, the dividing walls 455 define four compartments 460 for receiving and holding products (not illustrated) on the tray 450. With the dividing walls 455 aligned perpendicularly and each extending from the center of the tray 450, the compartments 460 are formed with each having substantially the same size and shape. In other embodiments, not only may a different number of compartments 460 be created by using a different number of walls 455, but each such compartment 460 may be formed having a different size and/or shape, depending on the placement and orientation of the dividing walls 455 employed. Also partially visible from this top view are a plurality of tray securing features 480, which correspond with the lid securing features 425 discussed above to secure the lid 400 on the tray 450.

Figure 21:
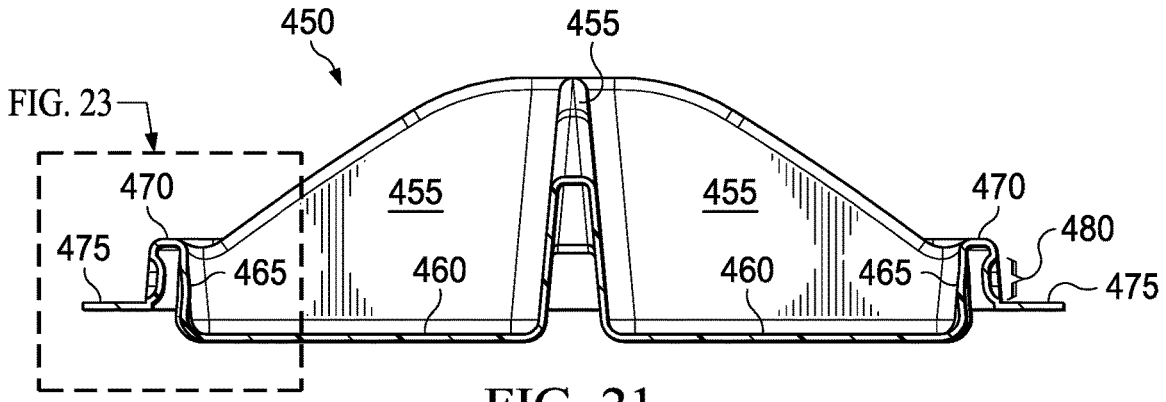
FIG. 21 illustrates a side cross-sectional view of the rigid tray of FIG. 20 taken across line 21-21.

Turning now to FIG. 21, illustrated is a side cross-sectional view of the rigid tray 450 of FIG. 20 taken across line 21-21. From this side view, the dividing walls 455 can be seen being integrally formed with the remainder of the tray 450, and rising up from the bottom surface of the tray 450. Also rising up from the bottom surface of the tray 450 is a raised lip 465. This raised lip 465 along with the dividing walls 455 form the multiple compartments 460 of the tray 450. A slight variation in tapering of inner portions 465*a* of the raised lip 465, versus the rounded lip corners 465*b* may also be seen from this view.

Also visible from this side view of the rigid tray 450 are the downward slopes formed in the walls 455, when moving from the center of the tray 450 to the raised lip 465. Although not required, by providing such slopes to the dividing walls 455, the product held in the compartments 460 can be more easily viewed and grasped by a consumer, as discussed in detail above. Outwardly extending from the raised lip 465 is a tray skirt 470 surrounding the periphery of the tray 450. In this embodiment, the tray skirt 470 includes a horizontally extending portion and a downwardly extending portion extending therefrom. The tray securing features 480 may also be partially visible on the downward extending portions of the tray skirts 470. In addition, the rigid tray 450 includes a tray flange 475 laterally extending outwardly from a tray skirt 470. The tray flange 475 extends outwardly from the bottom edge of the downward portion of the tray skirt 470.

Figure 22:
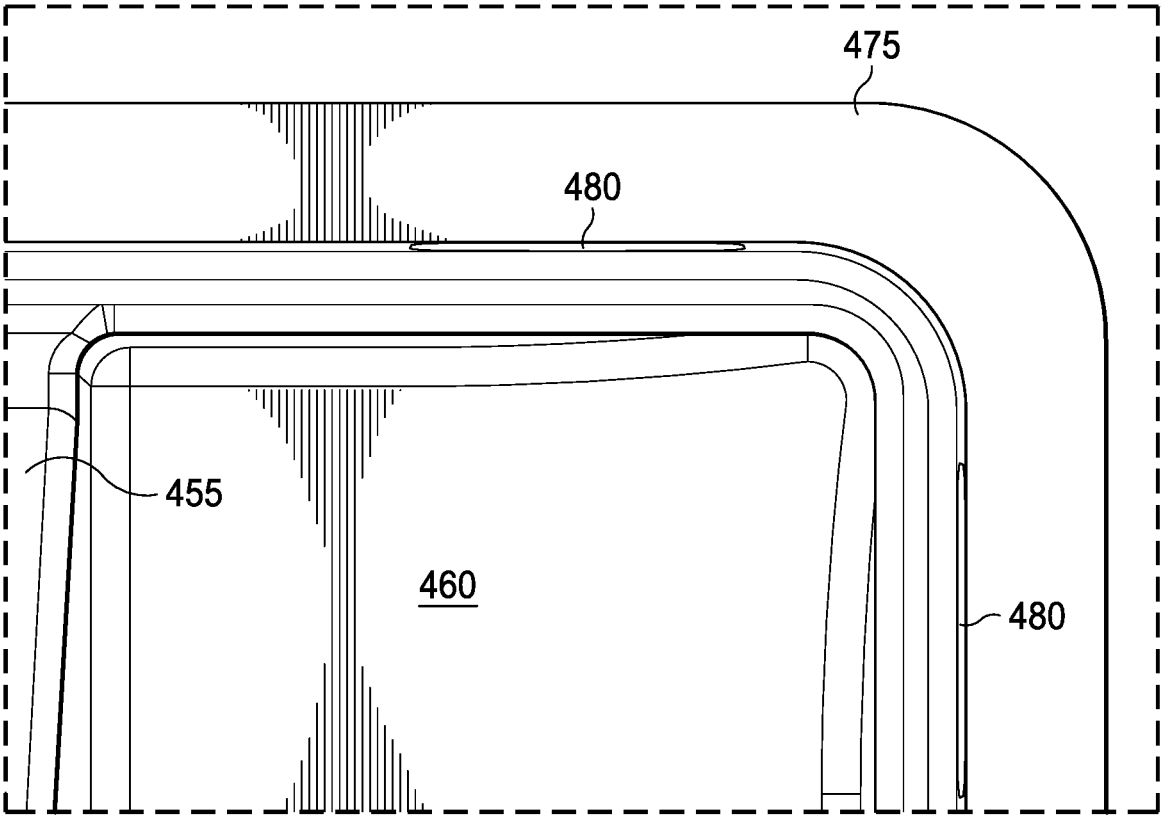
FIG. 22 illustrates a close up detail view of a portion of the rigid tray of FIG. 20.

Turning now to FIG. 22, illustrated is a close up detail view of a portion of the rigid tray 450 of FIG. 20. This close up view is a top view of one of the corners of the square-shaped rigid tray 450 of this embodiment of a recloseable package according to the disclosed principles. From this detailed view, a portion of one of the compartments 460 for holding product may be seen, as well as a portion of the raised lip 465 and tray skirt 470 formed around the periphery of the tray 450. The rounded corner of both the raised lip 465 and the tray skirt 470 can also be seen. In addition, a portion of the tray flange 475 may be seen along with a round corner of the flange shape used in this embodiment of the tray 450. Two of the tray securing features 480 discussed above may also be seen in this detail view.

Figure 23:
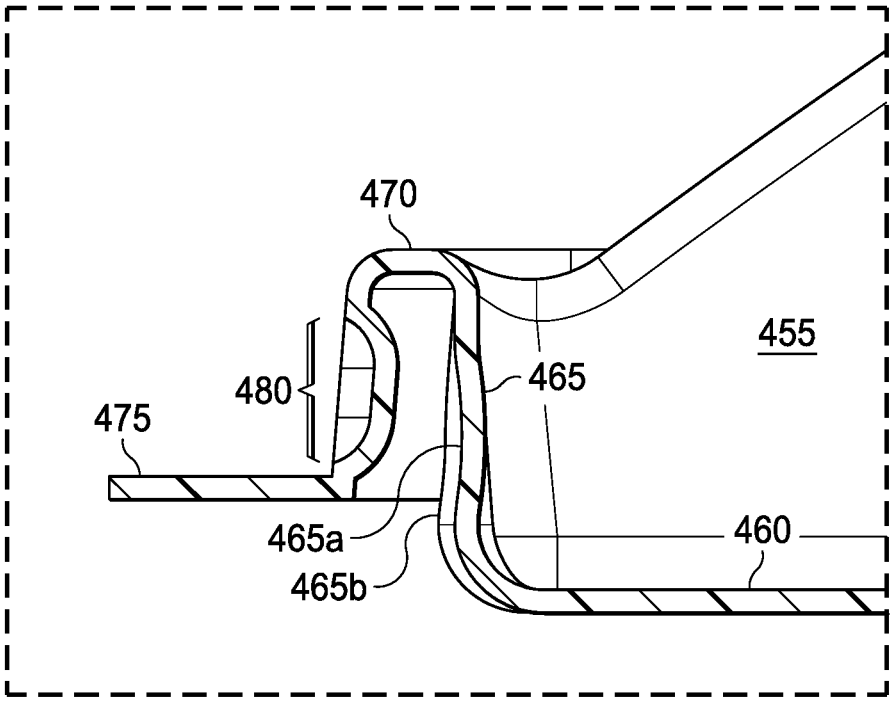
FIG. 23 illustrates a close up detail view of a portion of the rigid tray of FIG. 21.

Turning finally to FIG. 23, illustrated is a close up detail view of a portion of the rigid tray 450 of FIG. 21. From this close up view, a profile of the tray skirt 470 and the laterally extending tray flange 475 can easily be seen. Also, the curvature of the downward portion of the tray skirt 470 can be seen from this profile view. Additionally, this view illustrates the tray portion of the securing feature 480 of the package, for securing the lid 400 onto the tray 450. The lid securing features 425 and the tray securing features 480 are again formed as corresponding concave curved features formed into the downward portions of the lid skirt 420 and tray skirt 480, respectively. These corresponding curvatures cooperate as discussed in detail above to secure the lid 400 onto the tray 450 when the package is closed.

In other embodiments discussed above, grasping tabs are provided on corner portions of the lid and tray flanges for grasping by a consumer to pull in opposite directions and overcome the securing features to lift the lid from the tray. However, in this embodiment of a package, grasping tabs are not provided on the flanges 415, 475. Instead, the inset portions 415*a* of the lid flanges 415 do not laterally extend as far out as the tray flanges 475, while the other portions of the lid flanges 415 are coextensive with the tray flanges 475. As such, portions of the tray flange 475 are exposed when viewing the package with the lid 400 secured onto the tray 450. With this non-coextensive portion of the lid flange 415, a consumer is able to easily separate the tray flange 475 from the inset portion 415*a* of the lid flange by simply pressing down on the exposed portion of the tray flange 475. By slightly pressing down this area of the tray flange 475, the consumer can then easily separate the lid flange 415 from the tray flange 475 with enough force to overcome the securing features, and then pull the lid 400 off of the tray 450. As with other embodiment of packages formed as disclosed herein, the flanges 415, 475 in this embodiment may again be used create a seal for the package that may be pealed apart by the consumer. The technique used to form such a seal may be as described above. The formation of such a seal using the flanges 415, 475 allows the package to be hermetically sealed, and usable for any number of food products. To reclose the package, the consumer can simply place the lid 400 back onto the tray 450 and press the lid skirt 420 down onto the tray skirt 470 until to the two come together and the securing features reengage, as with the other embodiments of a disclosed package described above.

In the numerous embodiments of the inventive subject matter disclosed herein, such embodiments may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus the following claims are hereby incorporated into the Detailed Description, with each claim standing on its own as a separate embodiment.

The description has made reference to several exemplary embodiments. It is understood, however, that the words that have been used are for description and illustration, rather than words of limitation. Changes may be made within the purview of the appended claims, as presently stated and as amended, without departing from the scope and spirit of the disclosure in all its aspects. Although this description makes reference to particular means, materials and embodiments, the disclosure is not intended to be limited to the particulars disclosed; rather, the disclosure extends to all functionally equivalent technologies, structures, methods and uses such as are within the scope of the appended claims.

What is claimed is:

1. A recloseable package having a quadrilateral shape, comprising:

a rigid tray comprising:

a product surface having a perimeter and configured to hold one or more food products thereon, a raised lip along the perimeter of, extending from, and substantially orthogonal to the product surface to define an inner portion of the tray and being configured to laterally secure the one or more food products on the product surface, the raised lip terminating in a top edge, a tray skirt horizontally extending from the top edge substantially orthogonally to the raised lip in a direction away from the inner portion, at least one vertically extending tray component located between two adjacent corners, with each vertically extending tray component extending downwardly from the tray skirt in a direction generally parallel with and spaced from the raised lip, and having a distal end terminating in a flange laterally extending away from the raised lip, with each vertically extending tray components including a securing feature having an inwardly curved portion; and one or more dividing features upwardly extending from the product surface and configured to form distinct compartments on the product surface of the tray for receiving the one or more food products therein; and a recloseable rigid lid comprising:

an upper surface substantially coextensive with the product surface, at least one sidewall orthogonal to and extending downwardly from the upper surface to define an inner portion of the lid, the at least one sidewall terminating in a bottom edge, a lid skirt horizontally extending outward from the bottom edge and substantially orthogonally to the at least one sidewall in a direction away from the at least one sidewall inner portion, at least one vertically extending lid components located between two adjacent corners, with each vertically extending lid component extending downwardly from the lid skirt in a direction generally parallel with and spaced from the at least one sidewall, and having a distal end terminating in a flange laterally extending away from the at least one sidewall, with each vertically extending lid components including a complementary securing feature having an inwardly complementary curved portion configured to mate with the curved portion to removably secure the lid on the tray.

2. A recloseable package according to claim 1, wherein the securing feature and the complimentary shaped securing feature comprise an outwardly curved portion horizontally coextensive with each corresponding vertically extending component.

3. A recloseable package according to claim 1, further comprising respective corresponding sealing flanges horizontally extending outward from the corresponding vertically extending components, the corresponding sealing flanges configured to be sealed to one another to hermetically seal the lid on the tray.

4. A recloseable package according to claim 1, further comprising a pull tab spaced from the vertically extending tray and lid components and horizontally extending outward from respective the tray skirt and lid skirt, the pull tab configured to be grasped by a consumer to remove the lid from the tray.

5. A recloseable package according to claim 1, wherein the rigid lid is at least semi-transparent.

6. A recloseable package according to claim 1, wherein the one or more dividing features are integrally formed as a unitary piece with the product surface of the tray.

7. A recloseable package according to claim 1, wherein the distinct compartments formed by the one or more dividing features each comprise substantially the same shape and size.

8. A recloseable package according to claim 1, wherein the one or more dividing features comprise a downward slope when moving from a center of the tray to the raised lip.

9. A recloseable package having a quadrilateral shape, comprising:

a rigid tray comprising:

a product surface having a perimeter configured to hold one or more food products thereon, a raised lip along the perimeter of, extending from, and substantially orthogonal to the product surface to define an inner portion of the tray and being configured to laterally secure the one or more food products on the product surface, the raised lip terminating in a top edge, a tray skirt extending from the top edge substantially orthogonally to the raised lip, the tray skirt comprising:

a horizontal component extending outwardly from a top edge of the raised lip, at least one vertical extending tray component extending downwardly from an outer edge of the horizontal component, having a distal end terminating in a flange extending laterally away from the raised lip, and including a securing feature having an inwardly curved portion, and a tray skirt pull tab horizontally extending outward from the vertically extending component; and one or more dividing features upwardly extending from, and integrally formed as a unitary piece with the product surface and configured to form distinct compartments on the product surface of the tray for receiving the one or more food products therein, the at least one dividing feature comprising a downward slope when moving from a center of the tray to the raised lip; and a recloseable rigid lid that is at least semi-transparent, the lid comprising:

an upper surface substantially coextensive with the product surface, at least one sidewall orthogonal to and downwardly extending from the upper surface to define an inner portion of the lid, the at least one sidewall terminating in a bottom edge, and a lid skirt extending outward from a bottom edge of and substantially orthogonally to the at least one sidewall in a direction away from the at least one sidewall inner portion, the lid skirt comprising:

a horizontal component extending outwardly from a bottom edge of the at least one sidewall, at least one vertical extending lid component extending downwardly from an outer edge of the horizontal component, having a distal end terminating in a flange extending laterally away from the horizontal component, and including a complementary securing feature having a complementary inwardly curved portion configured to mate with the curved portion to removably secure the lid on the tray, and a lid skirt pull tab horizontally extending outward from the vertically extending component, the tray skirt pull tab and the lid skirt pull tab each configured to be grasped by a consumer to remove the lid from the tray.

10. A recloseable package according to claim 9, wherein the securing feature and the complimentary shaped securing feature comprise an outwardly curved portion horizontally coextensive with each corresponding vertically extending component.

11. A recloseable package according to claim 9, further comprising respective corresponding sealing flanges horizontally extending outward from the corresponding vertically extending components, the corresponding sealing flanges configured to be sealed to one another to hermetically seal the lid on the tray.

12. A recloseable package according to claim 9, wherein the distinct compartments formed by the at least one dividing feature each comprise substantially the same shape and size.

13. The recloseable package according to claim 1, wherein the top edge and the bottom edge are adjacent each other when the complementary curved portion is mated with the curved portion.

14. The recloseable package according to claim 1, wherein each vertically extending tray component extends below the top edge.

* * * * *